US007997382B2

(12) United States Patent
Hagiwara

(10) Patent No.: US 7,997,382 B2
(45) Date of Patent: Aug. 16, 2011

(54) EXHAUST DEVICE FOR STRADDLE-TYPE VEHICLE AND STRADDLE-TYPE VEHICLE

(75) Inventor: Itsurou Hagiwara, Shizuoka (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 12/431,578

(22) Filed: Apr. 28, 2009

(65) Prior Publication Data

US 2009/0272601 A1 Nov. 5, 2009

(30) Foreign Application Priority Data

Apr. 30, 2008 (JP) ..... 2008-119091
Jul. 2, 2008 (JP) ..... 2008-173558

(51) Int. Cl.
*F01N 1/02* (2006.01)
*F01N 1/10* (2006.01)
*F01N 1/24* (2006.01)
*F01N 13/08* (2006.01)

(52) U.S. Cl. ..... 181/249; 181/227; 181/250; 181/251; 181/252; 181/256

(58) Field of Classification Search ..... 181/249, 181/250, 251, 227, 256, 252
See application file for complete search history.

(56) References Cited

U.S. PATENT DOCUMENTS 3,263,772 A * 8/1966 Irwin et al. ..... 181/227
3,631,792 A * 1/1972 Bodine ..... 60/299
3,648,803 A * 3/1972 Heath et al. ..... 181/250
3,780,826 A * 12/1973 Hubbell, III. ..... 181/227
4,174,020 A * 11/1979 Challis ..... 181/211
4,252,212 A * 2/1981 Meier ..... 181/248
4,263,981 A * 4/1981 Weiss et al. ..... 181/252
4,529,060 A * 7/1985 Komauer et al. ..... 181/227
5,350,888 A * 9/1994 Sager et al. ..... 181/247
5,365,025 A * 11/1994 Kraai et al. ..... 181/249
5,602,368 A * 2/1997 Kaneso ..... 181/255
5,783,780 A * 7/1998 Watanabe et al. ..... 181/229
5,783,782 A * 7/1998 Sterrett et al. ..... 181/272

(Continued)

FOREIGN PATENT DOCUMENTS

JP 2006-307793 11/2006

(Continued)

OTHER PUBLICATIONS

Encyclopedia Britannica Academic Edition, Article: muffler, accessed Dec. 2, 2010, http://www.britannica.com/EBchecked/topic/396086/muffler?anchor=ref1071437.*

*Primary Examiner* — Elvin G Enad
*Assistant Examiner* — Christina Russell
(74) *Attorney, Agent, or Firm* — Dickstein Shapiro LLP

(57) ABSTRACT

An exhaust device for a straddle type vehicle allowing a compact design while still satisfying the sound deadening characteristic requirements is provided. The exhaust device for a straddle type vehicle comprising: an exhaust pipe that is connected to an engine; a silencer that is connected to the exhaust pipe wherein the exhaust pipe is provided with a Helmholtz resonator, and the Helmholtz resonator is filled with a sound absorbing material. The Helmholtz resonator is formed with an opening that communicates with the inside of the exhaust pipe. The opening is formed in a place where the sound pressure in the exhaust pipe is high during the operation of the engine.

16 Claims, 30 Drawing Sheets

U.S. PATENT DOCUMENTS

| | | | | |
|---|---|---|---|---|
| 6,106,276 | A * | 8/2000 | Sams et al. | 431/114 |
| 6,199,658 | B1 * | 3/2001 | Huff | 181/265 |
| 6,354,398 | B1 * | 3/2002 | Angelo et al. | 181/256 |
| 6,520,286 | B1 * | 2/2003 | Frederiksen et al. | 181/256 |
| 6,571,910 | B2 * | 6/2003 | Storm | 181/264 |
| 7,472,774 | B1 * | 1/2009 | Monson et al. | 181/256 |
| 7,510,050 | B2 * | 3/2009 | Emler | 181/249 |
| 7,549,510 | B2 * | 6/2009 | Sakurai et al. | 181/252 |
| 2004/0262077 | A1 * | 12/2004 | Huff et al. | 181/250 |
| 2007/0102236 | A1 * | 5/2007 | Uhlemann et al. | 181/250 |
| 2007/0227810 | A1 * | 10/2007 | Sakurai et al. | 181/251 |
| 2007/0227811 | A1 * | 10/2007 | Sakurai et al. | 181/256 |
| 2008/0023265 | A1 * | 1/2008 | Frederiksen et al. | 181/257 |
| 2008/0080977 | A1 * | 4/2008 | Bonnet | 416/229 A |
| 2008/0257642 | A1 * | 10/2008 | Yamagiwa et al. | 181/292 |

FOREIGN PATENT DOCUMENTS

| | | |
|---|---|---|
| JP | 2007-231784 | 9/2007 |

* cited by examiner

EXHAUST DEVICE FOR STRADDLE-TYPE VEHICLE AND STRADDLE-TYPE VEHICLE

PRIORITY INFORMATION

This patent application is based on and claims priority under 35 U.S.C. §119 to Japanese Patent Application No. 2008-173558, filed on Jul. 2, 2008, which is hereby incorporated by reference and Japanese Patent Application No. 2008-119091, filed on Apr. 30, 2008, which is hereby incorporated by reference.

TECHNICAL FIELD

The present invention relates to an exhaust device for a straddle type vehicle and to a straddle type vehicle.

BACKGROUND

A muffler or exhaust device, used in a straddle type vehicle (such as a motorcycle), has opposing design requirements. A muffler or exhaust device is required to effectively exhaust gas from an engine with high efficiency and simultaneously reduce or deaden the exhaust sound that is produced when highly pressurized or heated exhaust gas is discharged.

Currently, noise regulations are tightening, causing the requirements of sound reduction or sound deadening to increase. For this reason, it is desirable to achieve sound reduction or sound deadening while maintaining exhaust efficiency. One example of a muffler for a motorcycle that attempts to address the competing requirements of exhaust efficiency and sound deadening is described in Japanese Unexamined Utility Model Application JP-A-2007-231784.

When a muffler or exhaust system design is considered for its exhaust efficiency only, it is preferable to keep the muffler or exhaust system as straight as possible. However, when the muffler is extended straightly, the muffler cannot be fit into the vehicle body of a motorcycle. Thus, a muffler is brought to the rear of the vehicle body with as subtle of bends as possible in order to minimize exhaust resistance. Furthermore, the design of a straightly extended muffler is often difficult to achieve because of the connection of the front wheel and the consideration of the lean angle. Normally, a muffler ideal in length for the engine performance, does not fit the shape of a motorcycle without modification. Compared to designing a muffler for a four-wheeled motor vehicle, it is very troublesome to design a muffler for a motorcycle that has a length optimized for the best performance, yet still maintains the best possible smooth shape to fit the shape of the motorcycle.

Exhaust efficiency is not the only issue. In a motorcycle, muffler weight has a great impact on operability. Because a motorcycle is light in body weight, an increase in weight as small as 1 kg can have a significant effect. In addition, operability of the motorcycle is also adversely affected if the center of gravity of the muffler is located to far from the center of gravity of the motorcycle.

No matter how carefully the structure of the muffler is designed, a certain muffler capacity is still required in order to meet sound deadening requirements. A muffler usually has to be enlarged in order to conform to tightening noise regulations. Additionally, if the weight of the muffler is reduced by using a thinner metal plate during construction, the thinner metal plate will vibrate more and increase the noise. Thus, the muffler weight tends to be unavoidably heavy. The increased weight of the muffler deteriorates the operability of the motorcycle.

In this way, the structural design of muffler for a motorcycle is determined by various opposing factors. It is extremely difficult to design a muffler that is compact while still maintaining exhaust efficiency and sound-deadening characteristics.

U.S. Pat. No. 3,263,772 describes a high frequency silencing element (reference numeral 16 in FIG. 1 of the same publication) attached to a pipe (reference numeral 10 in the same FIG. 1) as an exhaust gas system for an automobile. However, this high frequency silencing element is not a resonator. Specifically, high frequency components are silenced by the air in a cavity (reference numeral 22 in the same FIG. 2) of the high frequency silencing element or porous fibrous materials.

SUMMARY

The present invention has been made in view of the above mentioned problems. To this end, it is one object of the present invention to provide a muffler for a straddle type vehicle, which is compact in design while still satisfying sound deadening requirements and characteristics.

An exhaust device for a straddle type vehicle according to the present invention includes an exhaust pipe connected to an engine and a silencer connected to the exhaust pipe, in which the exhaust pipe includes a Helmholtz resonator, a sound absorbing material is filled in the Helmholtz resonator, an opening communicated with the inside of the exhaust pipe is formed in the Helmholtz resonator, and the opening is formed in a place where sound pressure on the inside of the exhaust pipe is high during the operation of the engine.

According to the present invention, the Helmholtz resonator is disposed in the exhaust pipe, and the sound absorbing material is filled within the Helmholtz resonator. Thus, in addition to the sound absorbing effect of the Helmholtz resonator, the peak level of the resonance frequency generated by the Helmholtz resonator can be reduced. As a result, the sound deadening effect can be enhanced even in situations where the silencer capacity cannot be enlarged because it would result in an unacceptable increase in muffler weight.

DETAILED DESCRIPTION

Although designs of an exhaust device (muffler) for a motorcycle have been developed under various limitations, the effectiveness of the sound deadening could not be increased without enlarging the silencer capacity. Unfortunately, an increase in the silencer capacity always brought a phenomenon that lowered the operability of the motorcycle. For example, in the muffler of a current four-cycle motocross motorcycle (particularly, a racing vehicle), silencer capacity is enlarged, thereby satisfying noise reduction and running performance but resulting in a muffler that is large and heavy. Because of noise regulations, the muffler cannot be made compact and light.

Furthermore, because of the damping characteristics of the exhaust system, there exists many low frequency peaks caused by the length of the exhaust pipe. These peaks, caused by the length of the exhaust pipe, are often a problem when trying to meet noise regulations. As a countermeasure, the whole damping characteristic level has been lowered in order to lower the respective peak levels created by the length of the exhaust pipe. The total damping characteristic level can be lowered by enlarging the trunk of the silencer to raise the expansion ratio or by performing multistage expansion. However, multistage expansion occasionally causes the resonance of a low frequency lumped parameter system, and may increase the noise. Therefore, damping efficiency is bad. In addition, if the silencer trunk is enlarged in order to increase the expansion ratio, the operability of the motorcycle is lowered.

The present inventor has realized an exhaust device (muffler) having a small and light silencer, while still satisfying running performance and noise characteristics, by introducing a new technical thought to an exhaust pipe.

Hereinafter, various embodiments of the present invention will be described with reference to the drawings. For the sake of simplifying the description, components having substantially the same function are indicated by the same reference numbers in the following drawings.

It is to be expressly understood that the present invention is not limited to the embodiments described below. Instead, other embodiments may be utilized and structural changes may be made without departing from the scope of the present invention.

Figure 1:
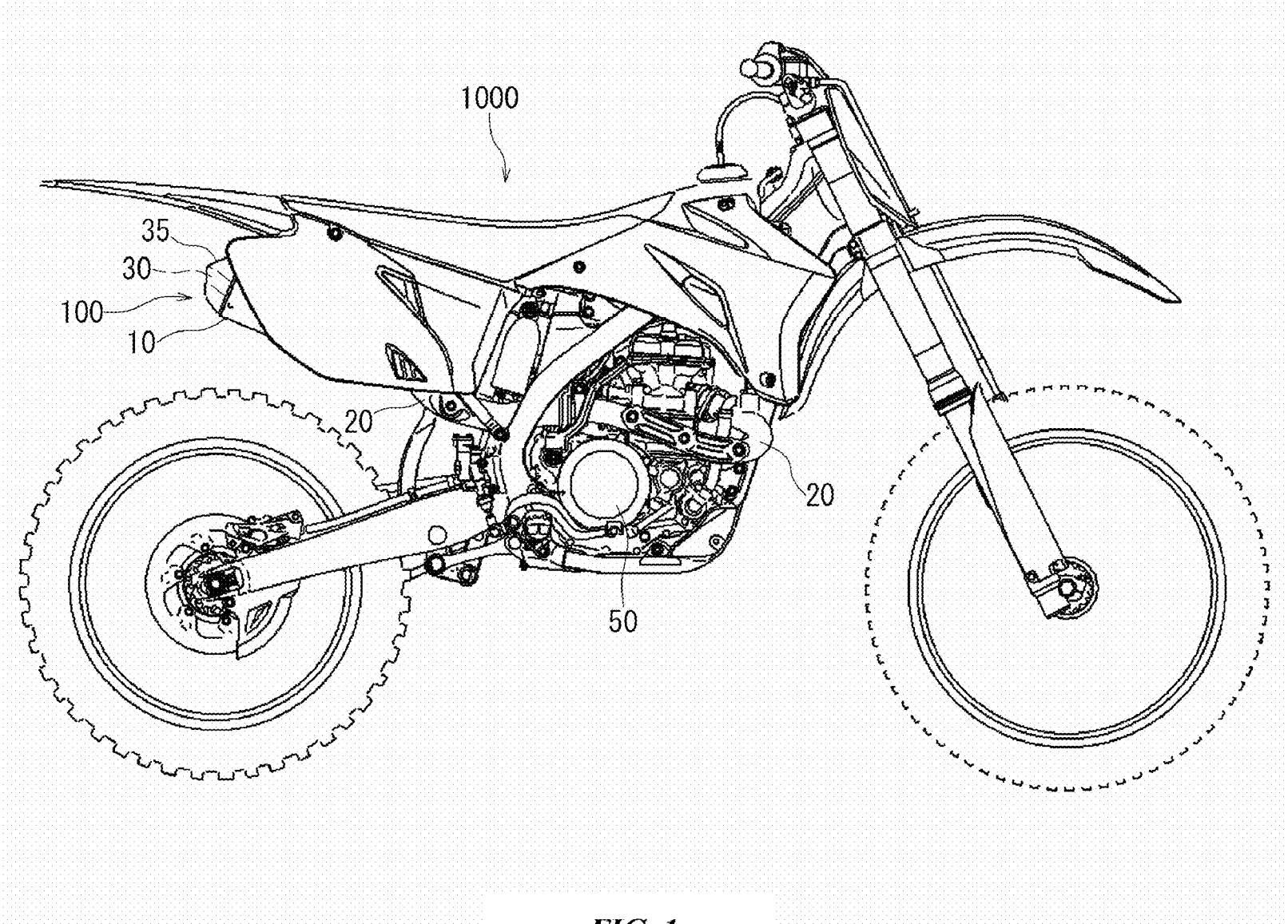
FIG. 1 illustrates a side view of a motorcycle 1000 with an exhaust device according to an embodiment of the present invention.

FIG. 1 shows a motorcycle 1000 in which an exhaust device (or muffler) 100 according to an embodiment of the present invention is mounted. The exhaust device 100 of the present embodiment is constituted by an exhaust pipe 20 connected to an engine 50 and a silencer 10 connected to the exhaust pipe 20. In the example showed in FIG. 1, a tail pipe 30 is arranged at the rear end (downstream side) of the silencer 10. The tail pipe 30 is covered by a tail cap 35. For convenience, the engine 50 side may be referred to as "upstream," and the atmosphere side, or rear end side of the silencer 10, may be referred to as "downstream."

In FIG. 1, the motorcycle 1000 is shown as an off-road type motorcycle; however, the motorcycle 1000 can be another type of motorcycle, including a street type motorcycle. "Motorcycle" in the specification of the present application includes all two-wheeled motor vehicles, and includes a motor-assisted bicycle and a scooter. Specifically, "motorcycle" is meant to refer to a vehicle that can turn direction by tilting the vehicle body. Thus, the present invention is not limited to a "two-wheeled motor vehicle," but is also applicable to a vehicle having two or more front wheels and/or two or more rear wheels and hence having a total of three or four (or more) wheels. Therefore, without any limitation to motorcycles, the present invention may also be applied to other vehicles, as long as the vehicle can take advantage of the effects of the invention. This includes any straddle-type vehicles such as four-wheeled buggies or all terrain vehicles (ATVs) and snowmobiles.

Figure 2:
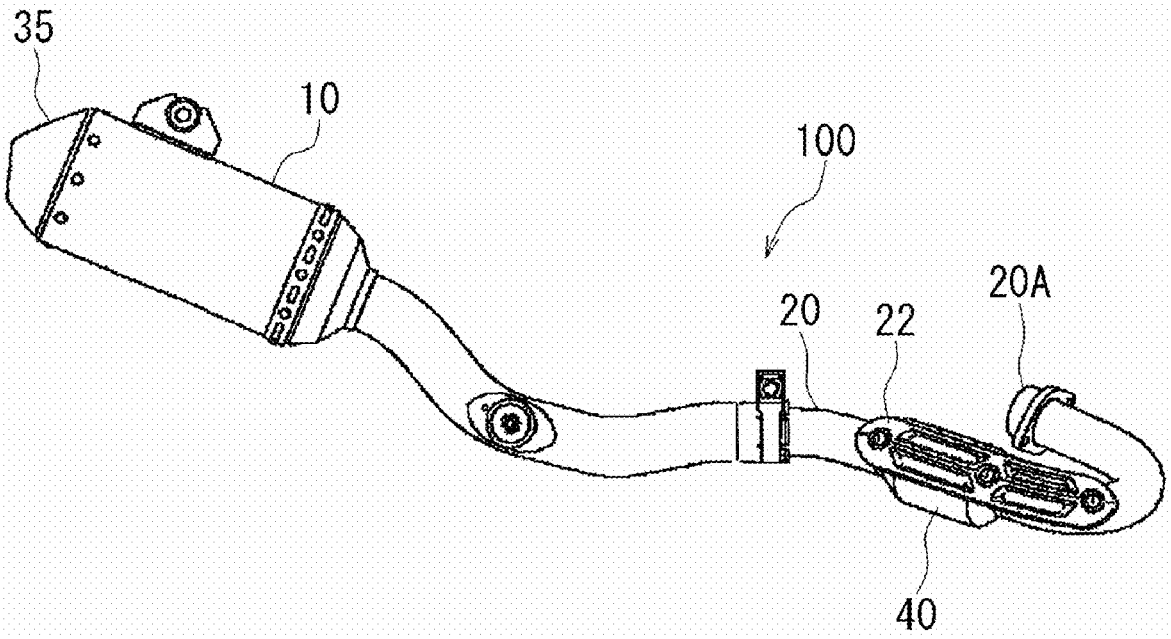
FIG. 2 illustrates a view showing an exhaust device 100 according to an embodiment of the present invention.
Figure 3A:
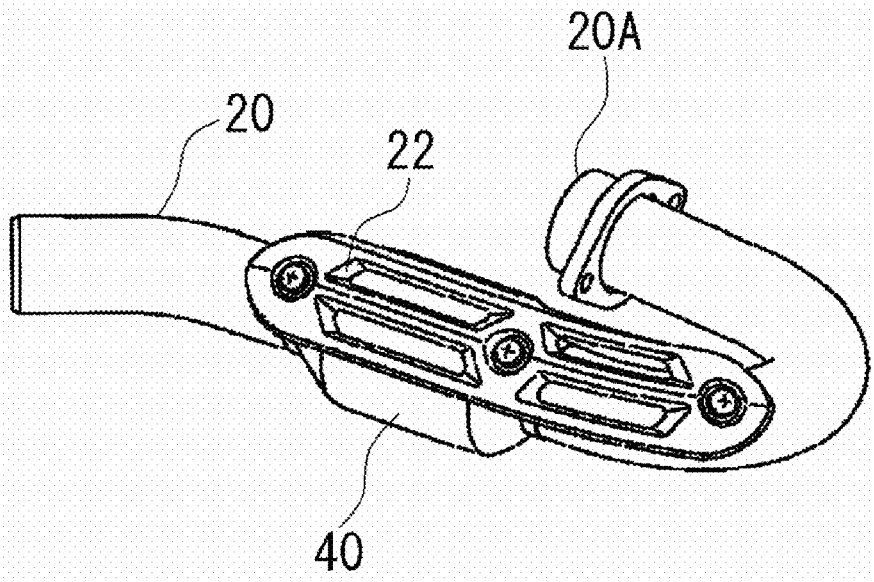
FIG. 3A illustrates a partially enlarged view of an exhaust device 100.
Figure 3B:
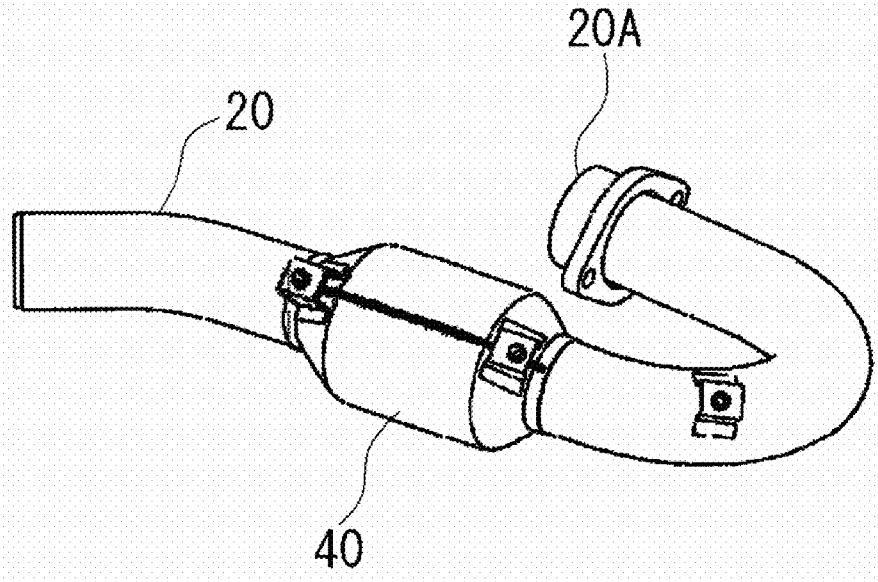
FIG. 3B illustrates a partially enlarged view of an exhaust device 100.

FIG. 2 illustrates the exhaust device 100 of the present embodiment removed from the motorcycle 1000. FIG. 2 shows a protector 22 for avoiding contact formed in the exhaust pipe 20 of the exhaust device 100. FIG. 3A shows the periphery of an upstream side end part 20A of the exhaust pipe 20. FIG. 3B shows the periphery of the upstream side end part 20A of the exhaust pipe 20, from which the protector 22 is removed.

As shown, the muffler 100 of the present embodiment is a muffler for a four-cycle engine; however, the muffler can be connected to any engine type including two, six, and eight cylinder engines or even a rotary engine. Here, the silencer 10 is attached to the rear of the exhaust device 100, specifically the rear of the exhaust pipe 20.

The exhaust pipe 20 of the present embodiment has a Helmholtz resonator 40 that is filled with a sound absorbing material. The Helmholtz resonator may simply be referred to as a "resonator."

Figure 4:
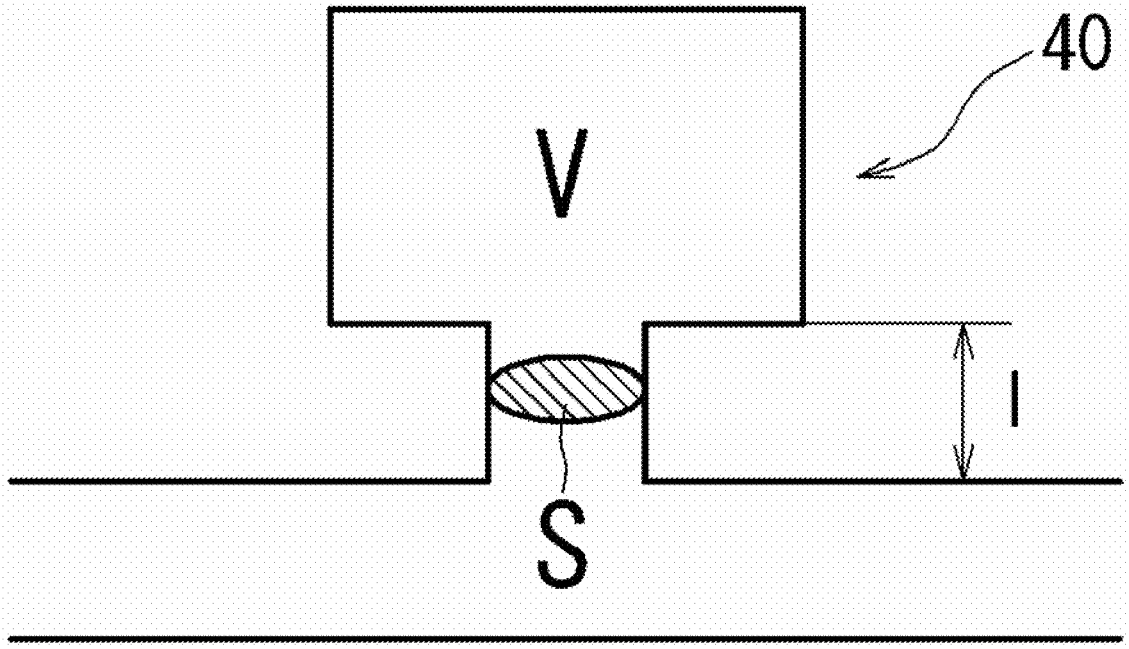
FIG. 4 is a diagram to illustrate a Helmholtz resonator 40.

FIG. 4 is a schematic illustrating a Helmholtz resonator. The resonance frequency $f_0$ of the Helmholtz resonator shown in FIG. 4 is obtained by a formula 1.

[Formula 1]

$$fo = \frac{c}{2\pi}\sqrt{\frac{S}{Vl}}\ \text{(Hz)} \qquad \text{(formula 1)}$$

$c$: speed of sound $V$: capacity $l$: length of neck (including pipe end collection)

$S$: cross section of neck

As shown by Formula 1, the Helmholtz resonator is extremely versatile because the resonance frequency can be adjusted by changing the diameter or length of the neck or the capacity of the cavity.

When sound near the resonance frequency enters the resonator, large aerial vibrations occur. This violent aerial vibration is changed to heat by the viscous resistance of the medium (air) through friction loss, and accordingly the sound is absorbed or damped. Here, "resonance" means that the vibrational energy of a first object is absorbed by a second object, and the second object vibrates accordingly.

When the Helmholtz resonator is mounted in a conduit, in this case an exhaust system, a damping improvement effect can be obtained in the proximity of the resonance frequency. However, the mounted resonator generates its own new resonance, and a secondary problem is produced.

In this regard, when sound enters a sound absorbing material (such as stainless steel wool (SUS wool), glass wool, porous metal, etc.), aerial vibration is directly transmitted to the space in the material or to the air of air bubbles in the material. As a result, the sound is absorbed by the viscous resistance of the air on the surface of the fiber and the air bubbles and by the vibration of the membrane of the fiber and the air bubbles themselves. Therefore, when the resonator is filled with a sound absorbing material, the sound absorbing effect of the resonator itself is suppressed.

In the construction of this embodiment, the idea that the sound absorbing effect of the resonator itself is suppressed by the sound absorbing material is reversely used to realize the structure that suppresses a peak level of new resonance. Thus, according to the exhaust device 100 of the present embodiment, a sound deadening effect can be enhanced even in a situation where the silencer capacity cannot be enlarged in order to suppress the increase of muffler weight.

Now, while referring to FIGS. 5A to FIG. 5K, description is made of the construction and the effect of the exhaust device 100 according to various embodiments of the present invention.

Figures 5A, 5B, 5C:
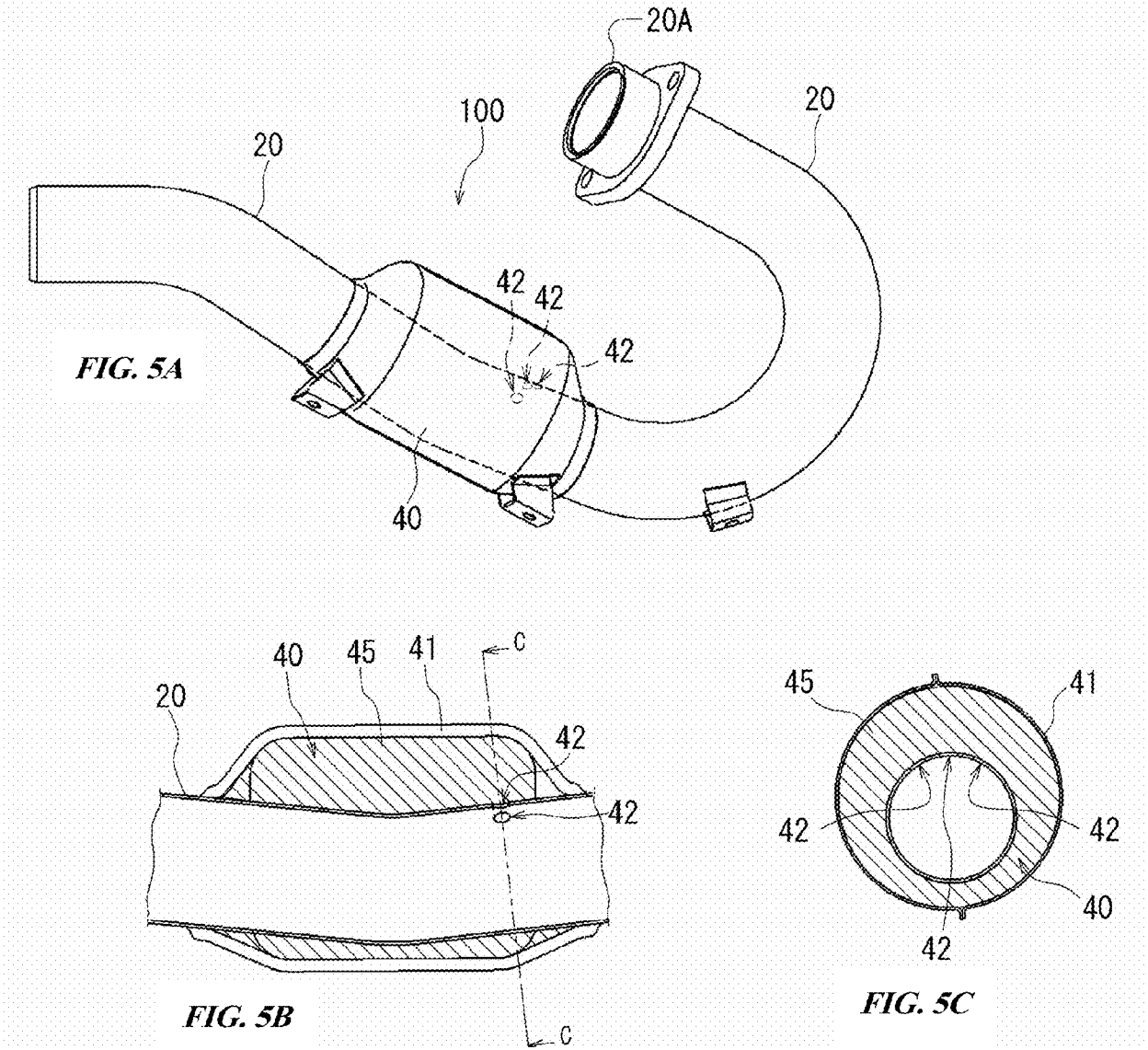
FIG. 5A illustrates a perspective view representing an exhaust pipe 20 according to embodiment 1 of the present invention.
FIG. 5B illustrates a cross sectional view of an exhaust pipe 20 in FIG. 5A.
FIG. 5C illustrates a cross sectional view cut along the line C-C in FIG. 5B.

FIG. 5A through FIG. 5C illustrates the resonator 40 of the exhaust device 100 according to a first embodiment (embodiment 1). FIG. 5A is a perspective view of the exhaust pipe 20 including the resonator 40. FIG. 5B is a cross sectional view of the exhaust pipe 20 shown in FIG. 5A. FIG. 5C is a cross sectional view of FIG. 5B cut across the line C-C.

In the exhaust device 100 shown in embodiment 1, the Helmholtz resonator 40 is disposed on the exhaust pipe 20. A sound absorbing material (for example, SUS wool) is filled in the Helmholtz resonator 40. The resonator 40 is constructed by an outer pipe 41 located on the periphery of the exhaust pipe 20 and a space formed by the exhaust pipe 20. In embodiment 1 shown in FIG. 5A through FIG. 5C, an opening (hole) 42, which is in communication with the inside of the exhaust pipe 20, is formed in an upstream side, end part 20A side, of the resonator 40. The opening 42 is formed in a place where the sound pressure in the exhaust pipe 20 is high, a place of "antinode" of standing waves, during the operation of the engine 50.

Next, a description of the place in the exhaust pipe 20, where the sound pressure is high, will be given. If described acoustically, the sound wave makes sine wave vibrations, pressure fluctuations, by compression waves in the air. A tubular component generates a certain resonance frequency standing waves. When looking at the phenomenon from a pressure fluctuation state, a place that has static pressure is referred to as "node." In other words, a place where the pressure is static in the sound wave or standing wave that makes sine wave vibrations is referred to as "node." On the other hand, a place that has higher pressure, particularly a place with locally high pressure, and a place that has lower pressure that is in the opposite phase of the higher pressure, particularly a place with locally low pressure, is referred to as an "antinode." In other words, a place where the pressure is high, and in addition, the place that has the opposite phase, is referred to as an "antinode."

Specifically, it is preferable that the exhaust pipe 20 can be modeled in a pipe part with one closed end and the other end open, and the opening 42 is formed in a place where the sound pressure of the standing wave generated in the exhaust pipe is high, at an antinode. Accordingly, a certain frequency peak can be intentionally reduced. For example, by forming the opening 42 in at least one of the antinodes from a third peak to a sixth peak of the exhaust pipe, a certain corresponding peak can be reduced. Since the periphery of the end part 20A of the exhaust pipe 20 tends to be in a place where the sound pressure in the exhaust pipe 20 is high, at an antinode of a standing wave, it is preferable to form the opening 42 in that region.

In embodiment 1 shown in FIG. 5A through FIG. 5C, three openings 42 are formed in an upstream side, in the end part 20A side, of the resonator 40. However, more than three openings 42 can be formed in the resonator 40 and the openings 42 can be located in other areas of the resonator 40 without departing from the disclosed invention. As another example, FIG. 5D through FIG. 5G illustrate an embodiment 2 with three openings 42 formed in the upstream side of the resonator 40, and three openings 42 formed in a downstream side of the resonator 40.

Figures 5D, 5E, 5F, 5G:
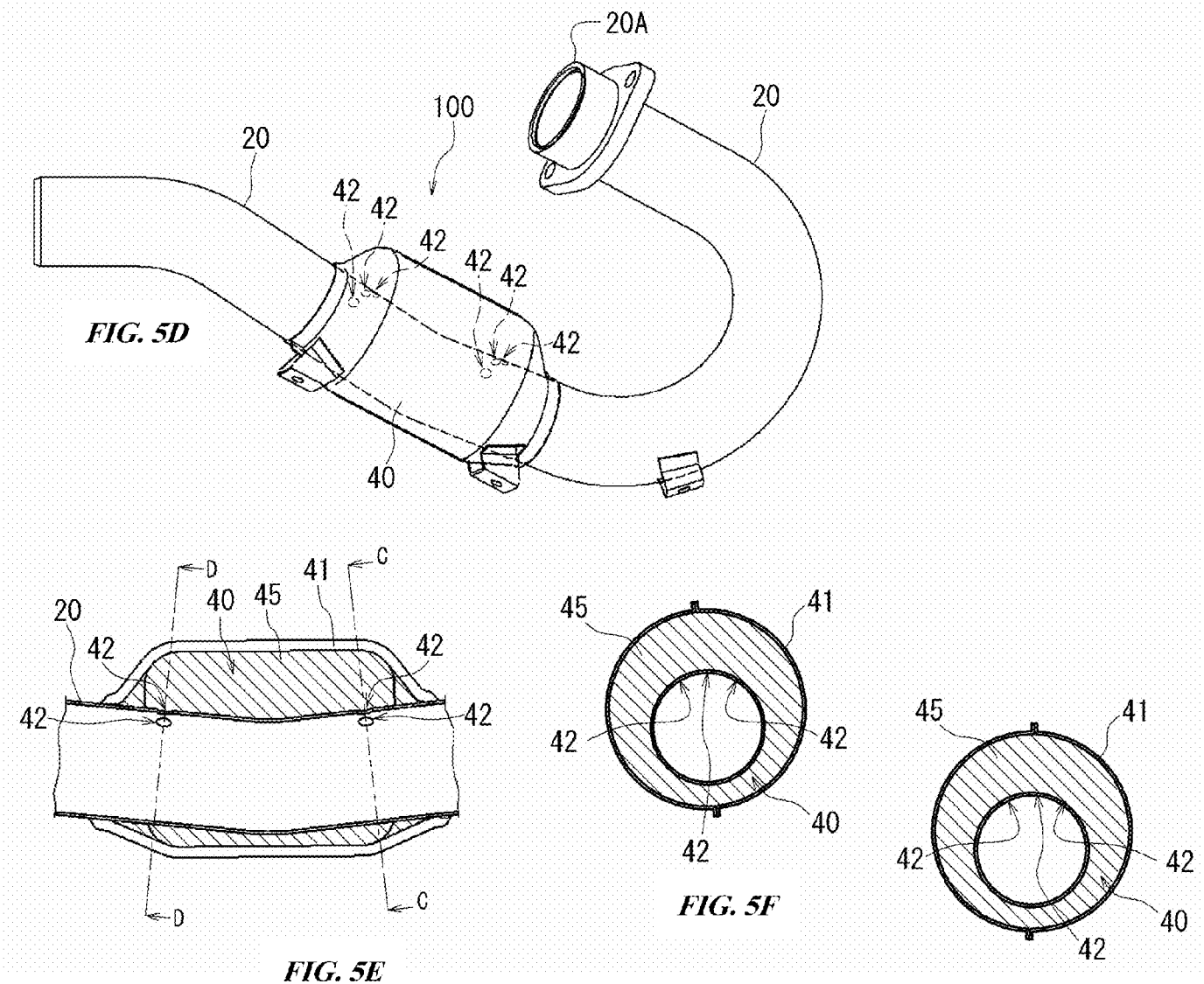
FIG. 5D illustrates a perspective view representing an exhaust pipe 20 according to embodiment 2 of the present invention.
FIG. 5E illustrates a cross sectional view of an exhaust pipe 20 in FIG. 5D.
FIG. 5F illustrates a cross sectional view cut along the lines C-C in FIG. 5E.
FIG. 5G illustrates a cross sectional view cut along the lines D-D in FIG. 5E.

FIG. 5D illustrates a perspective view of the construction of the embodiment 2. FIG. 5E is a cross sectional view of the exhaust pipe 20 including the resonator 40 shown in FIG. 5D. FIG. 5F and FIG. 5G are cross sectional views of FIG. 5E cut across the line C-C and the line D-D, respectively.

Figures 5H, 5I, 5J:
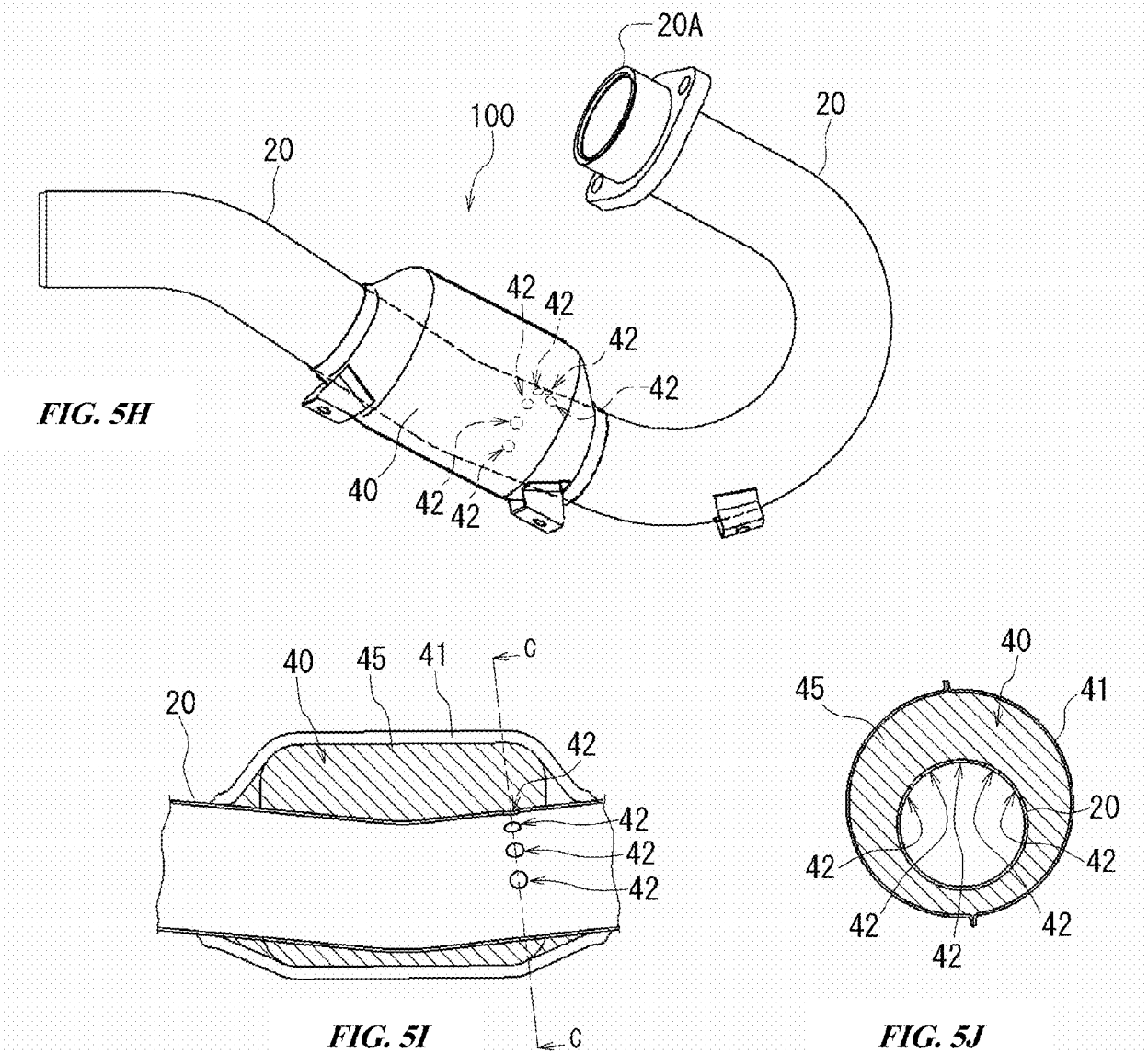
FIG. 5H illustrates a perspective view representing an exhaust pipe 20 according to embodiment 3 of the present invention.
FIG. 5I illustrates a cross sectional view of an exhaust pipe 20 in FIG. 5H.
FIG. 5J illustrates a cross sectional view cut along the line C-C in FIG. 5I.

Furthermore, an embodiment 3 is illustrated in FIG. 5H through FIG. 5J with six openings 42 formed in the upstream side of the resonator 40. FIG. 5H illustrates a perspective view of the construction of the embodiment 3. FIG. 5I is a cross sectional view of the exhaust pipe 20 including the resonator 40 shown in FIG. 5H. FIG. 5J is a cross sectional view of FIG. 5I cut across the line C-C.

Figure 5K:
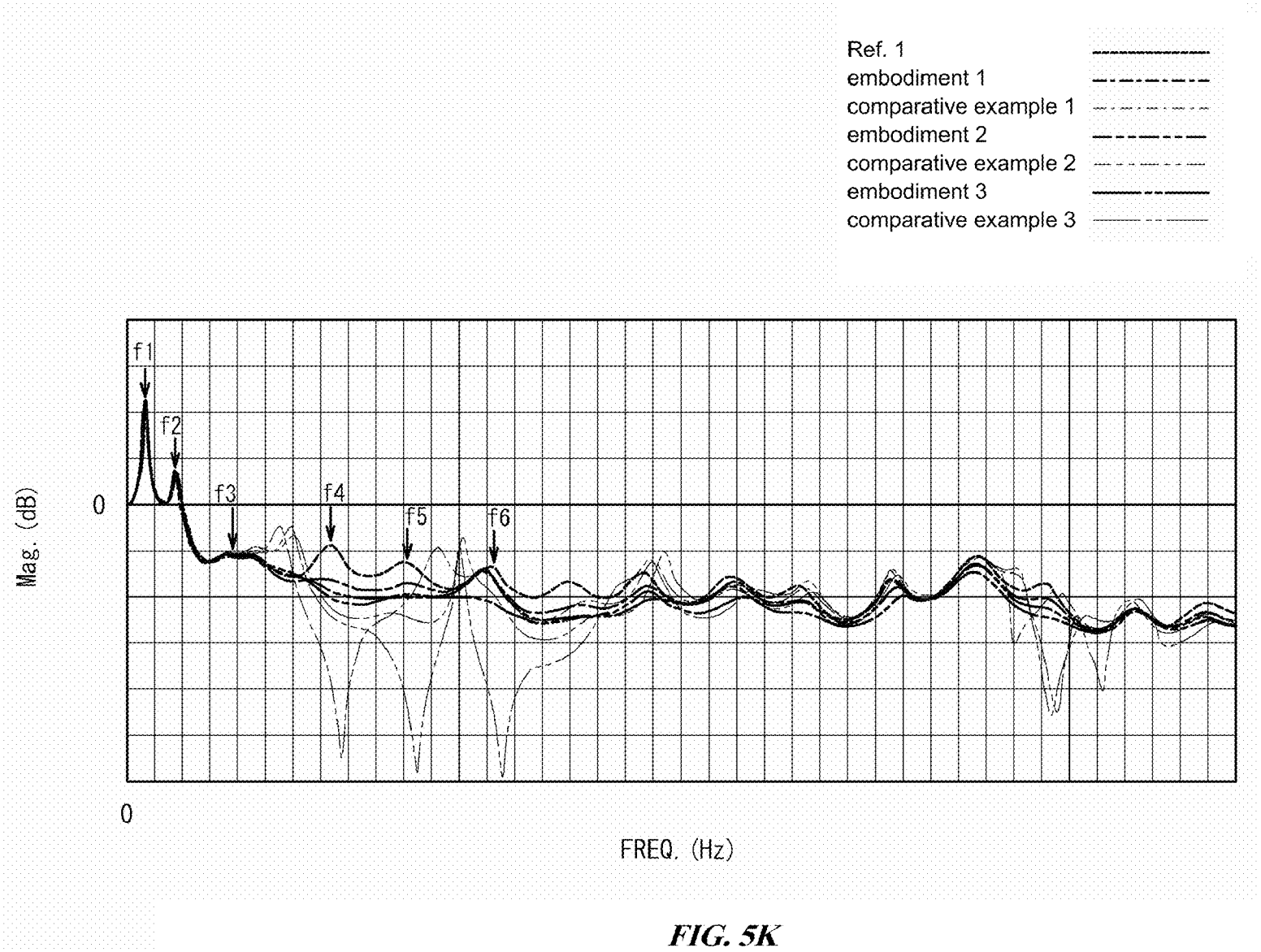
FIG. 5K illustrates a graph for describing a damping characteristic of a construction according to embodiments 1, 2, and 3 of the present invention.

Now, the effects of the exhaust device 100 of embodiments 1-3, are described with reference to FIG. 5K. FIG. 5K shows the results of a simulation study, performed by the inventor, illustrating the application of the exhaust device 100. FIG. 5K is a graph showing damping characteristics. The vertical axis represents damping level (dB), and the horizontal axis represents frequency (Hz).

The examples illustrated in FIG. 5K are the embodiments 1-3 shown in FIG. 5A through FIG. 5C, FIG. 5D through FIG. 5G, and FIG. 5H through FIG. 5J, respectively. In addition a comparative example (Ref. 1) is shown. The comparative example (Ref. 1) is a construction like the one in embodiment 1 except the resonator 40 does not exist. The density (loading weight) of SUS wool 45 filled in the Helmholtz resonator 40 of each embodiment described in FIG. K is held the same. Here, loading weight or density of the sound absorbing material (SUS wool) 45 is represented by mass (kg) of the sound absorbing material 45 that fills the capacity ($m^3$) of the resonator 40. For reference, embodiments 1-3 are also illustrated in FIG. 5K without the sound absorbing material as comparative examples 1-3, respectively.

More detailed relationships are described in various later embodiments. However, the opening 42 is formed in the exhaust pipe 20 on the place (antinode) where sound pressure corresponding to a certain frequency peak is high. The place (antinode) where sound pressure is high is based on the place where sound pressure is high in the exhaust pipe 20 before the opening 42 is formed.

As can be understood from FIG. 5K, damping levels (dB) at a desired frequency peak can be reduced by forming the opening 42 in certain places. In embodiments 1-3 shown in FIG. 5K, it can be understood that better damping characteristics are shown as compared to the comparative examples 1-3.

In further describing the point where the damping level of the desired frequency peak is reduced, embodiment 1 and embodiment 3 have openings 42 formed in on the upstream side of the resonator 40. However, in embodiment 1 and embodiment 3, the openings 42 are not formed on the downstream side of the resonator 40. On the other hand, in embodiment 2, the openings 42 are formed on the downstream side of the resonator 40. Henceforth, referring to FIG. 5K, it can be understood that the result of embodiment 2 is to effectively lower the damping level at the frequency peak f6.

Now, while referring to FIG. 6 through FIG. 10, description is further made of the construction and the effects of the exhaust device 100 according to other various embodiments of the present invention.

In the constructions shown in FIGS. 5A through 5J (embodiments 1-3) described above, it is intended that the structure of the Helmholtz resonator 40 is designed first, and then the openings 42 are formed in certain places of the exhaust pipe 20 in the region occupied by the resonator 40. In the construction of the embodiments described now, it is intended that the openings 42 are formed in the exhaust pipe 20 in the place where sound pressure is high (antinode), then the Helmholtz resonator 40 is formed.

Figure 6:
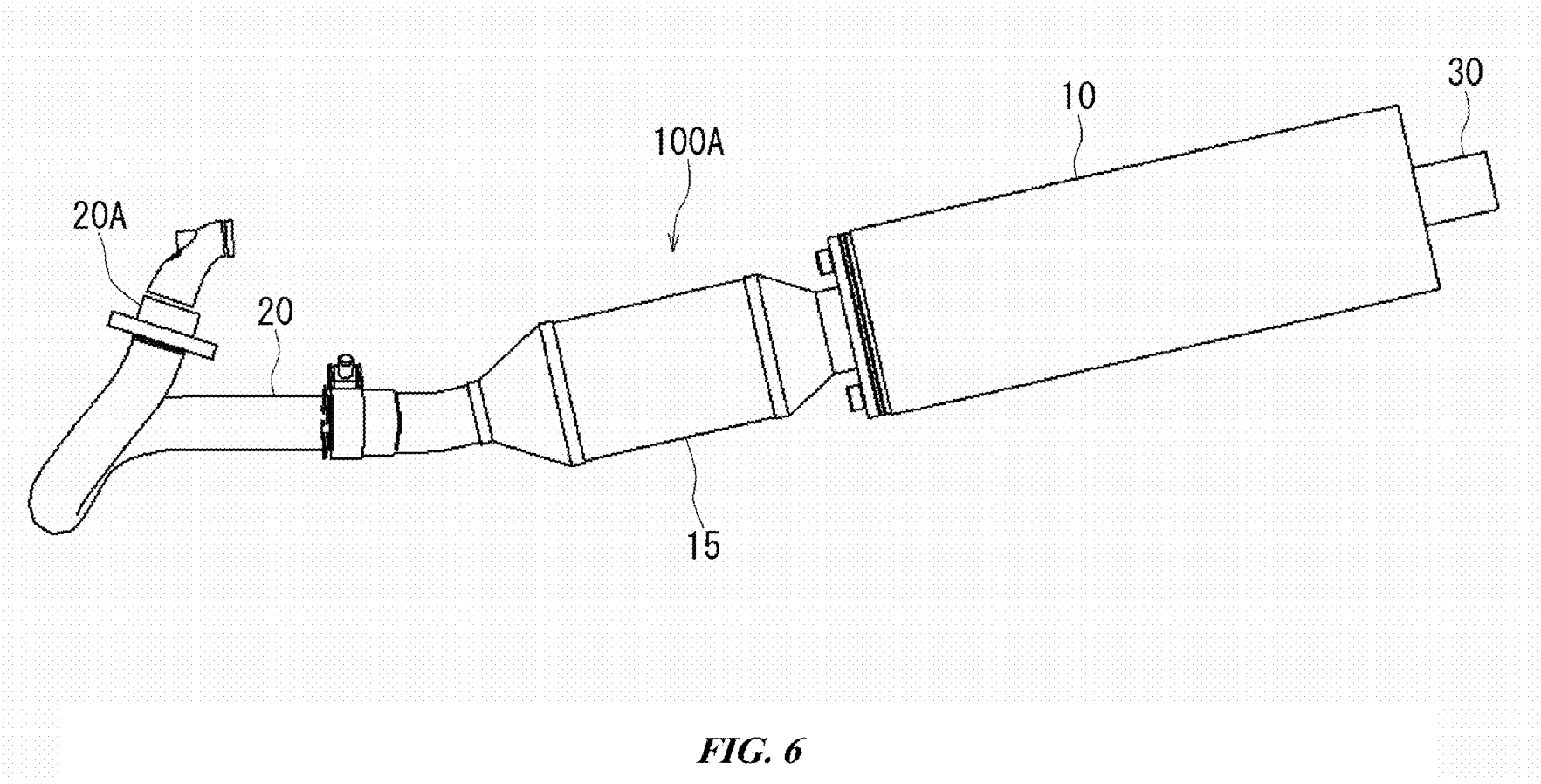
FIG. 6 illustrates a view representing an exhaust device 100A in a comparative example.
Figure 7:
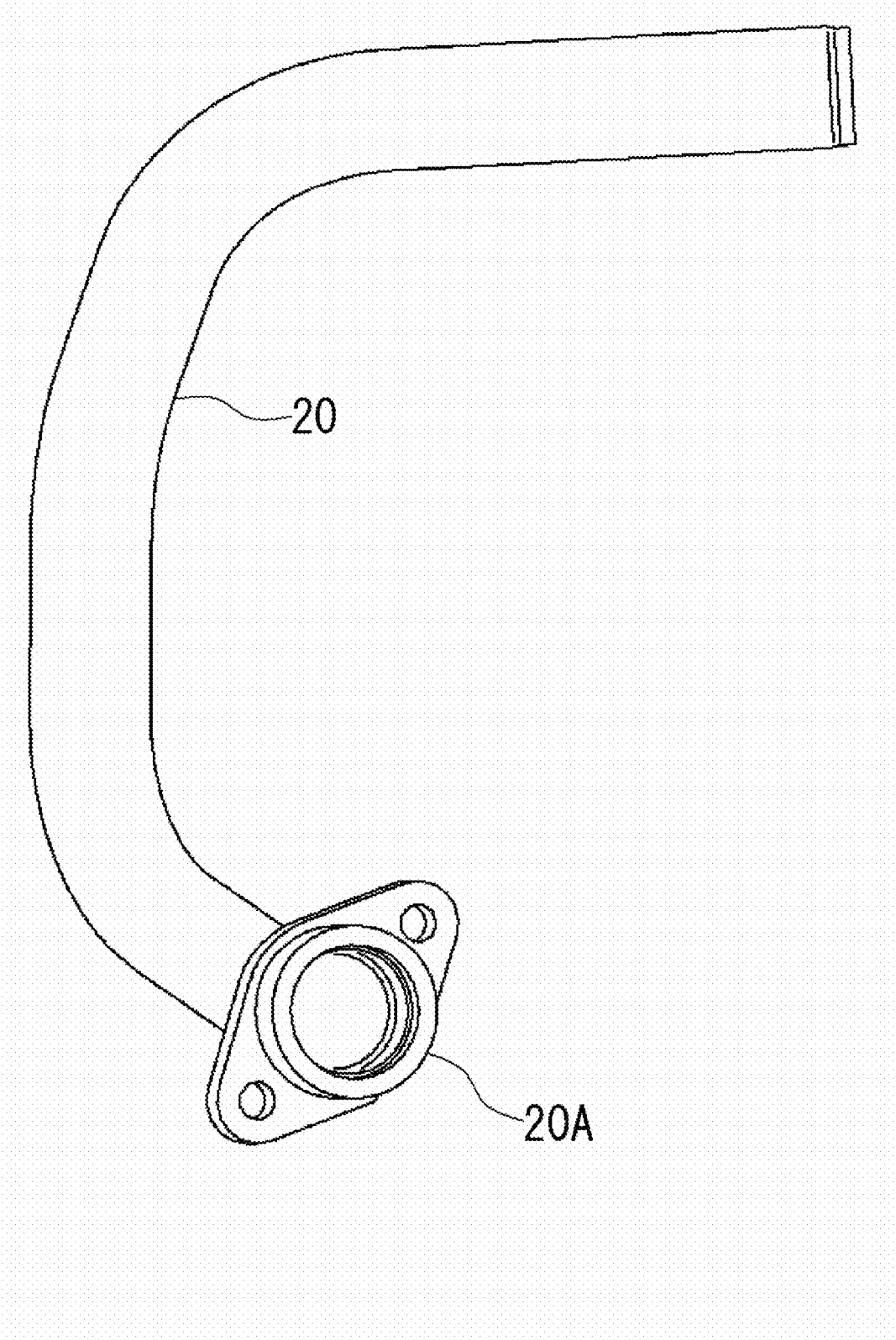
FIG. 7 illustrates a perspective view representing an exhaust pipe 20 in a comparative example.

FIG. 6 illustrates a view showing a comparative example exhaust device 100A of a basic construction. FIG. 7 illustrates a perspective view of the exhaust pipe 20 of the comparative example exhaust device 100A. The exhaust device 100A comprises the exhaust pipe 20 having an end part 20A connected to an engine side; the catalyst housing 15 connected to the exhaust pipe 20; and the silencer 10 connected to the catalyst housing 15. The tail pipe 30 is located in a downstream side of the silencer 10.

Figure 8:
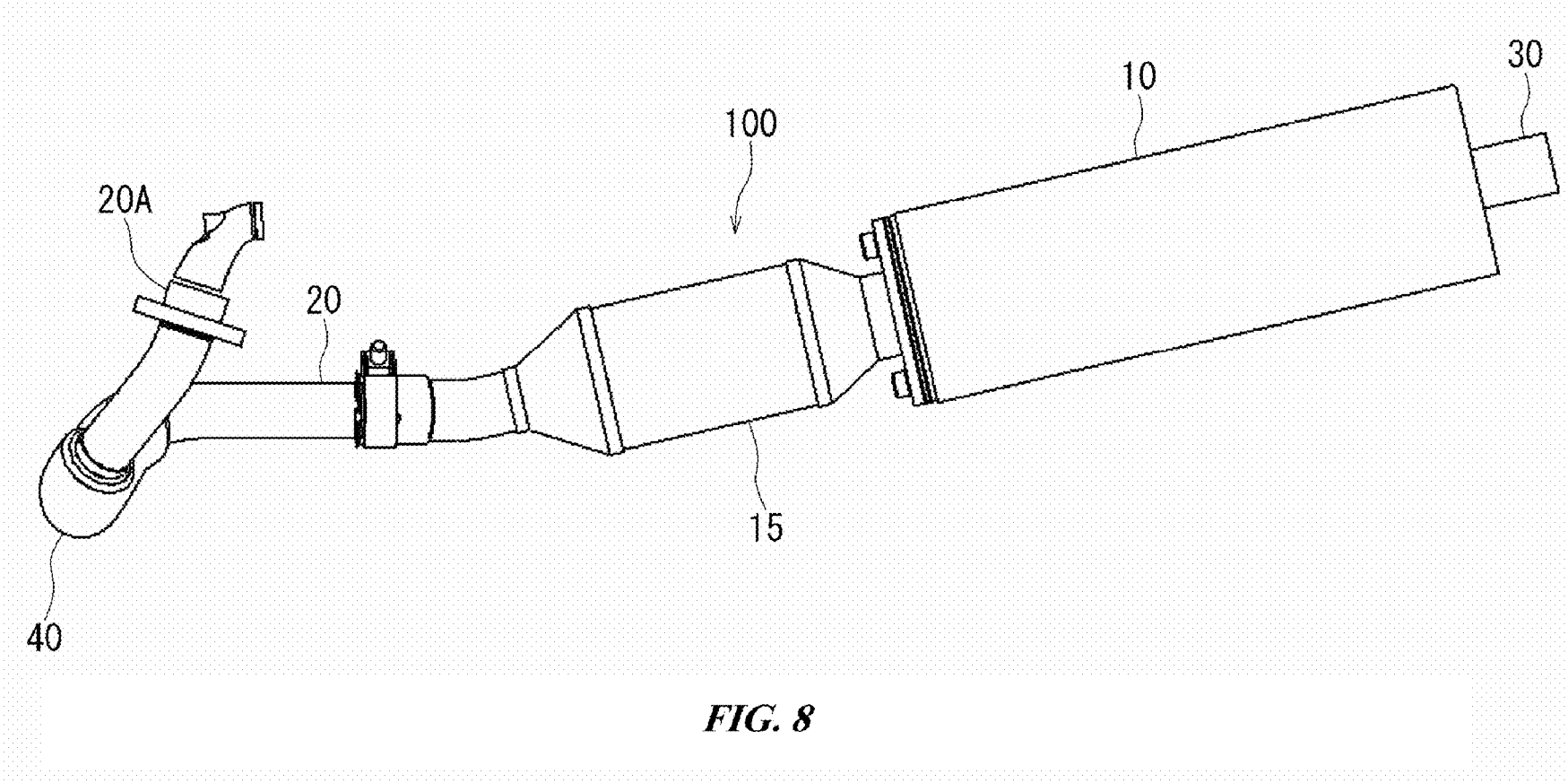
FIG. 8 illustrates a view representing an exhaust device 100 according to an embodiment of the present invention.

FIG. 8 is a view showing the exhaust device 100 of an embodiment (embodiment 4) of the present invention. In the exhaust device 100 shown in FIG. 8, the Helmholtz resonator 40 is disposed on the exhaust pipe 20. A sound absorbing material (for example, SUS wool) is filled in the Helmholtz resonator 40.

Figure 9:
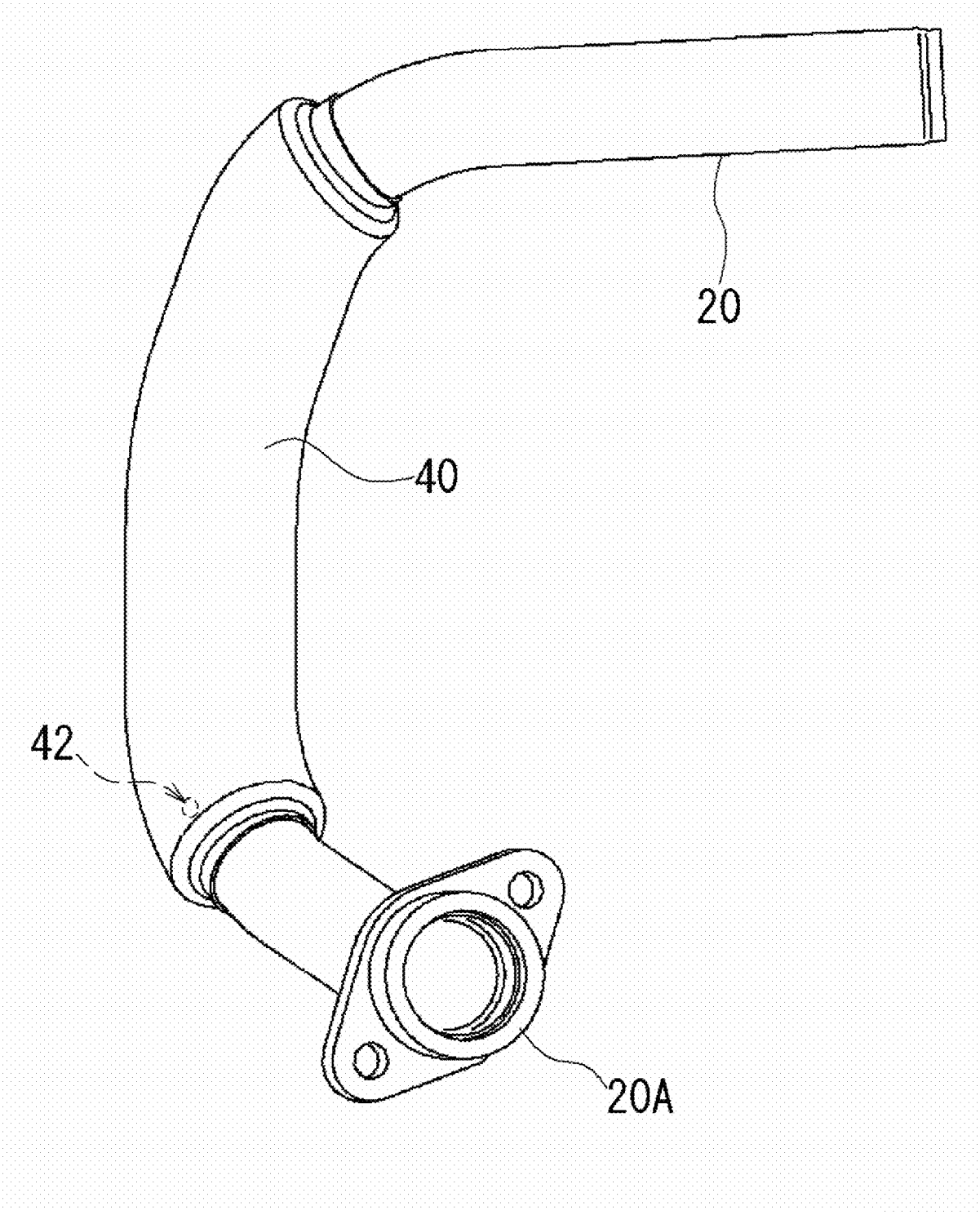
FIG. 9 illustrates a perspective view representing an exhaust pipe 20 according to embodiment 4 of the present invention.
Figure 10A:
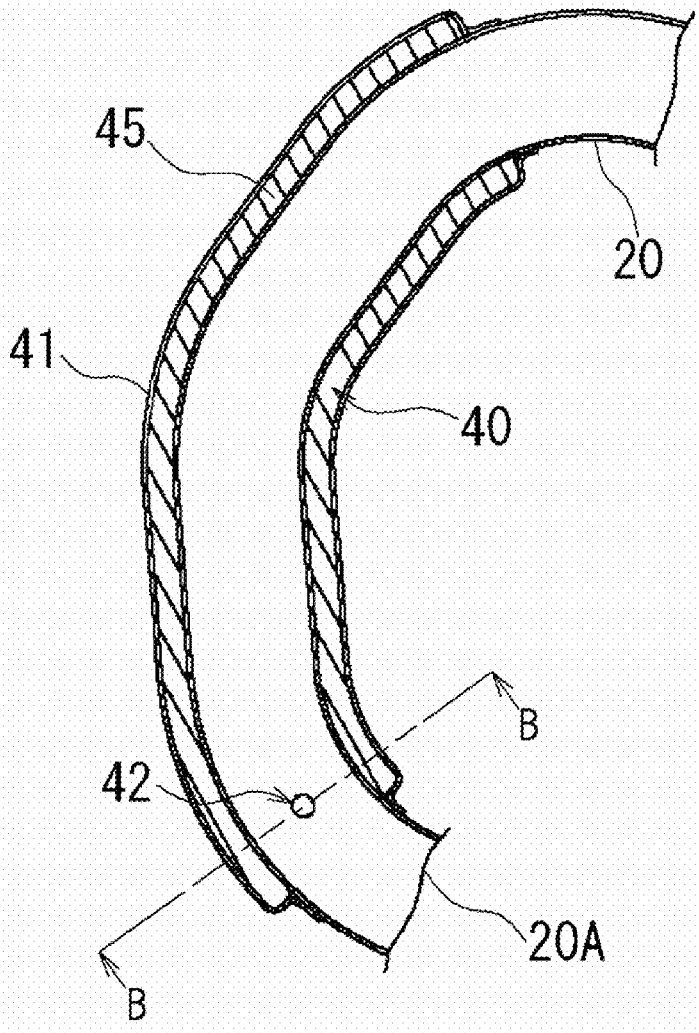
FIG. 10A illustrates a cross sectional view of an exhaust pipe 20 according to embodiment 4 of the present invention.
Figure 10B:
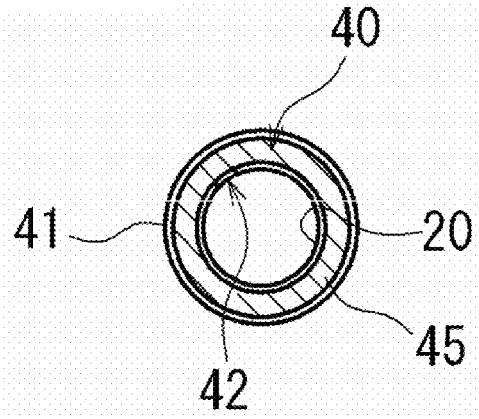
FIG. 10B illustrates a cross sectional view cut along the line B-B of FIG. 10A.

FIG. 9 (embodiment 4) is a perspective view of the exhaust pipe 20 of the exhaust device 100 shown in FIG. 8. FIG. 10A is a cross sectional view of the exhaust pipe 20 including the resonator 40 shown in FIG. 9. FIG. 10B is a cross sectional view cut along the line B-B in FIG. 10A. As described above, the resonator 40 is constructed by an outer pipe 41 located on the periphery of the exhaust pipe 20 and a space formed by the exhaust pipe 20.

In embodiment 4 shown in FIG. 9, an opening (hole) 42, which communicates with the inside of the exhaust pipe 20, is formed in an upstream side, end part 20A side, in the resonator 40. The opening 42 is formed in a place where sound pressure in the exhaust pipe 20 is high, a place of "antinode" of standing waves, during the operation of the engine 50. As described above, since the periphery of the end part 20A of the exhaust pipe 20 tends to be a place where sound pressure in the exhaust pipe 20 is high, where an antinode of a standing wave is located, it is preferable to form the opening 42 in that region.

The sound absorbing material 45 is filled in the resonator 40. The sound absorbing material 45 is a material that can absorb sound waves. For example, SUS wool (stainless steel wool), glass wool, aluminum wool, ferrite, asbestos, and the like can be used for the sound absorbing material 45. For comparative purposes, SUS wool is used for the sound absorbing material 45 in this example. The sound absorbing material 45 absorbs high frequency sound well, but is not very effective on low frequency sound. The exhaust device 100 should preferably be designed by considering this point.

The relationship in FIG. 4 and formula 1 can be applied to the Helmholtz resonator 40 of embodiment 4 shown in FIG. 9 as follows: neck part cross section S is the sum total of the opening area of the through-hole 42; neck part length I is a dimension of material thickness of the exhaust pipe 20; capacity V is the volume surrounded by the exhaust pipe 20 and the outer pipe 41.

Figure 11:
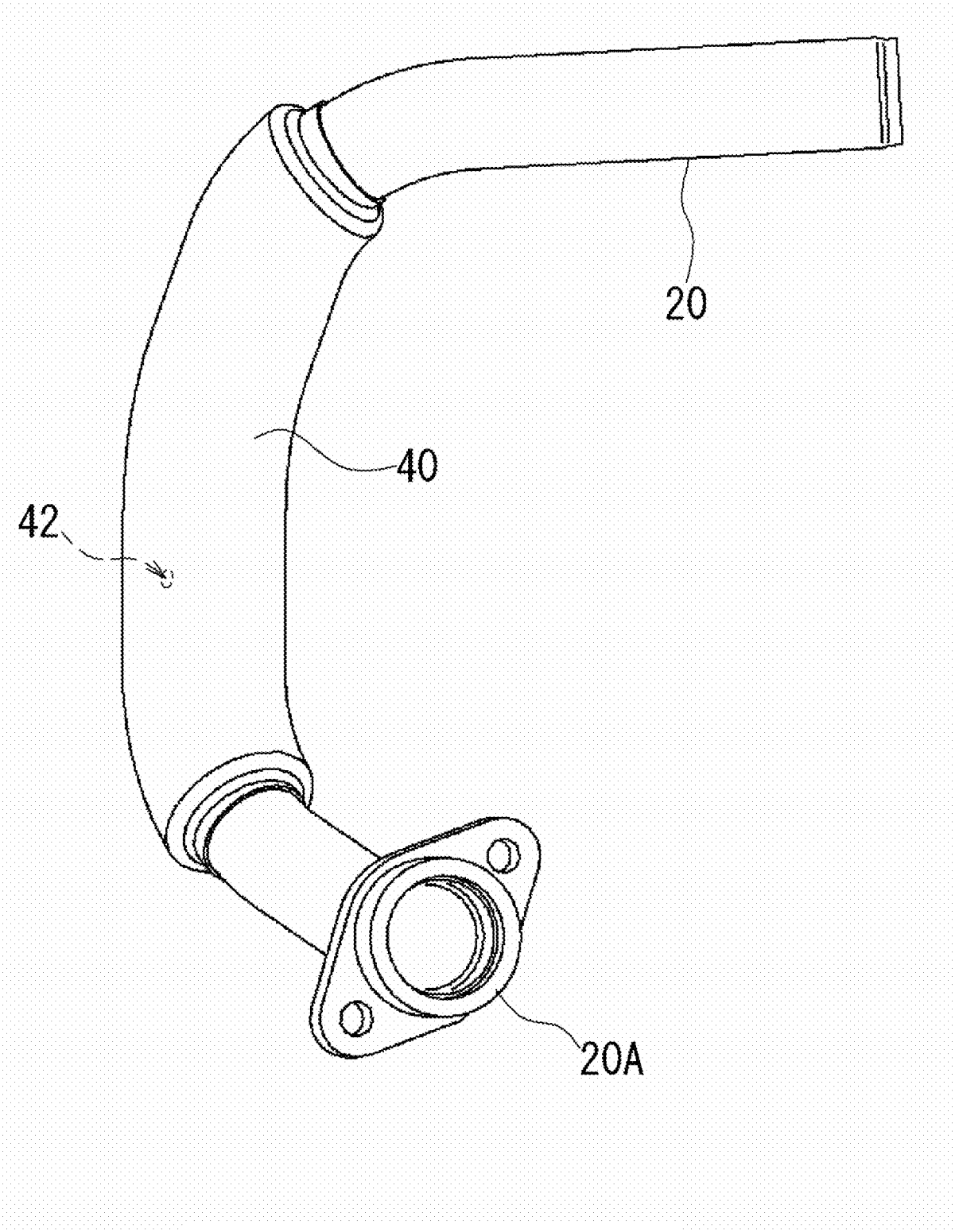
FIG. 11 illustrates a perspective view representing an exhaust pipe 20 according to embodiment 5 of the present invention.
Figure 12A:
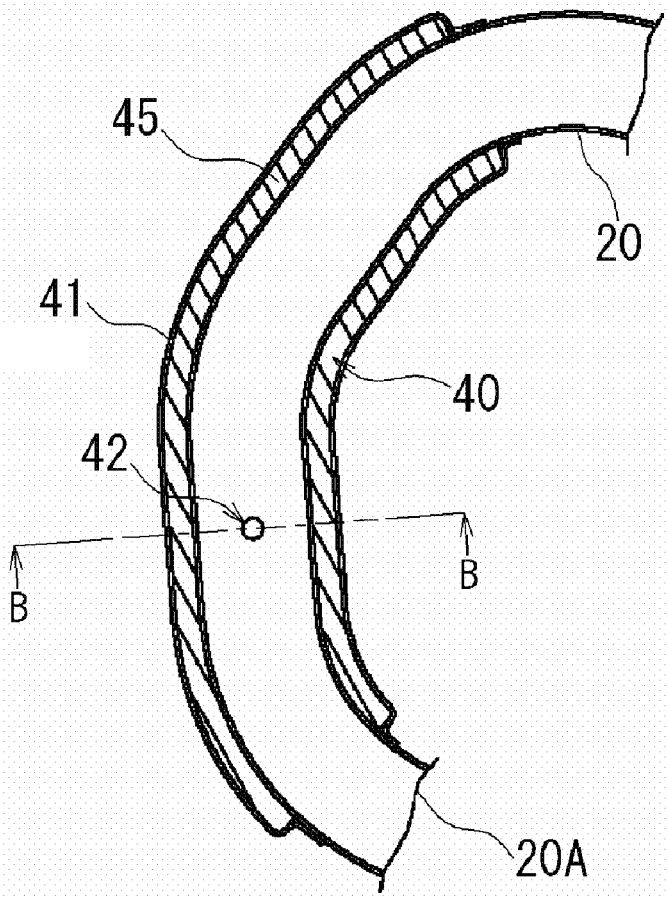
FIG. 12A illustrates a cross sectional view of an exhaust pipe 20 according to embodiment 5 of the present invention.
Figure 12B:
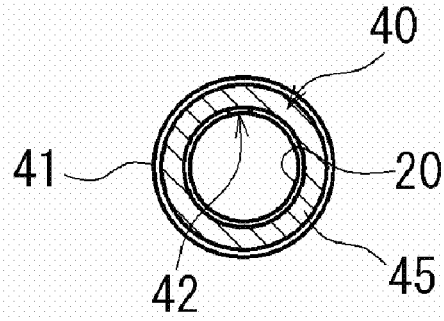
FIG. 12B illustrates a cross sectional view cut along the line B-B in FIG. 12A.

FIG. 11 illustrates another possible embodiment 5 of the present invention. In embodiment 5, shown in FIG. 11, the opening (hole) 42, which communicates with the inside of the exhaust pipe 20, is formed in the midstream of the resonator 40. FIG. 12A is a cross sectional view of the exhaust pipe 20 including the resonator 40 shown in FIG. 11. FIG. 12B is a cross sectional view cut along the line B-B in FIG. 12A.

Figure 13:
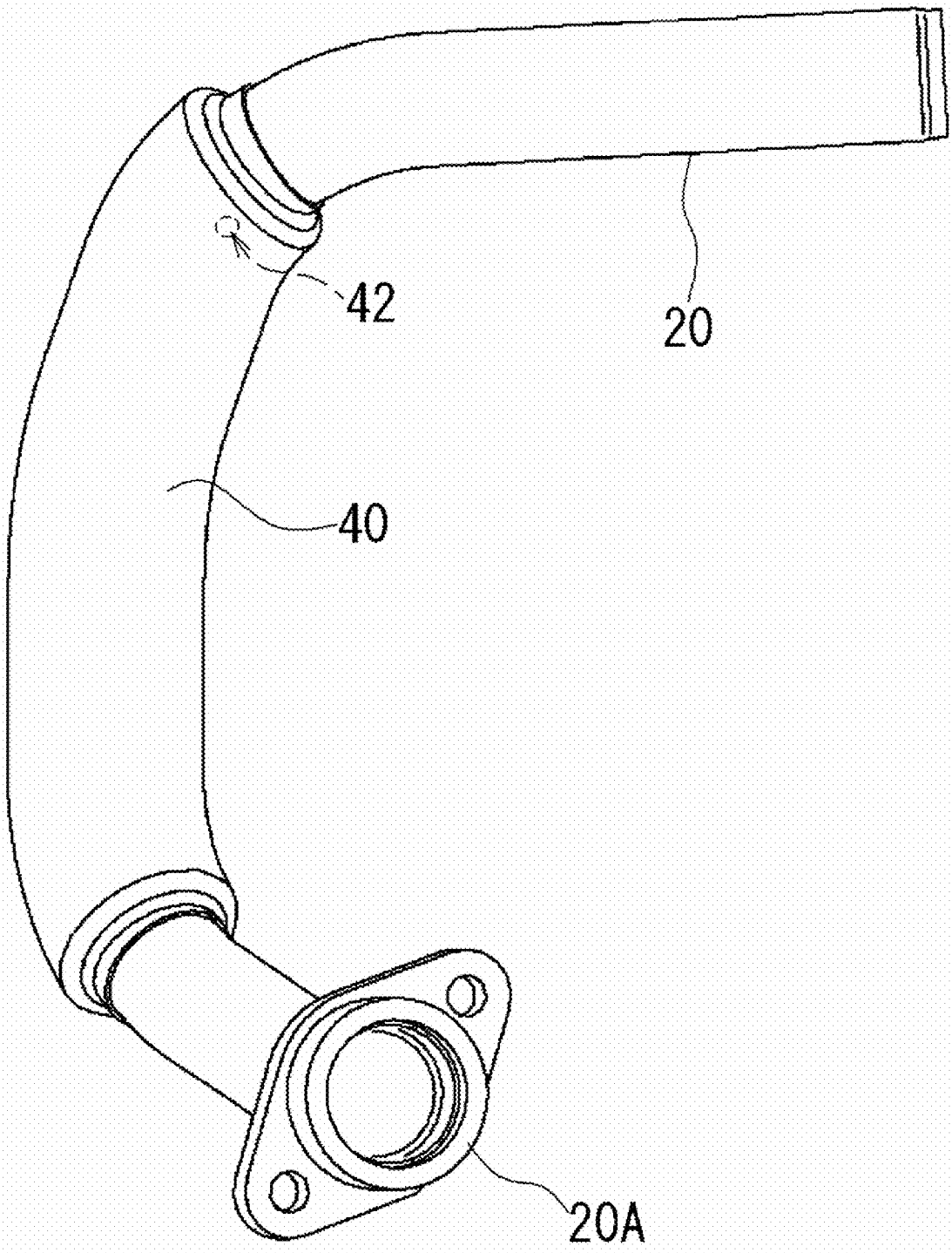
FIG. 13 illustrates a perspective view representing an exhaust pipe 20 according to embodiment 6 of the present invention.
Figure 14A:
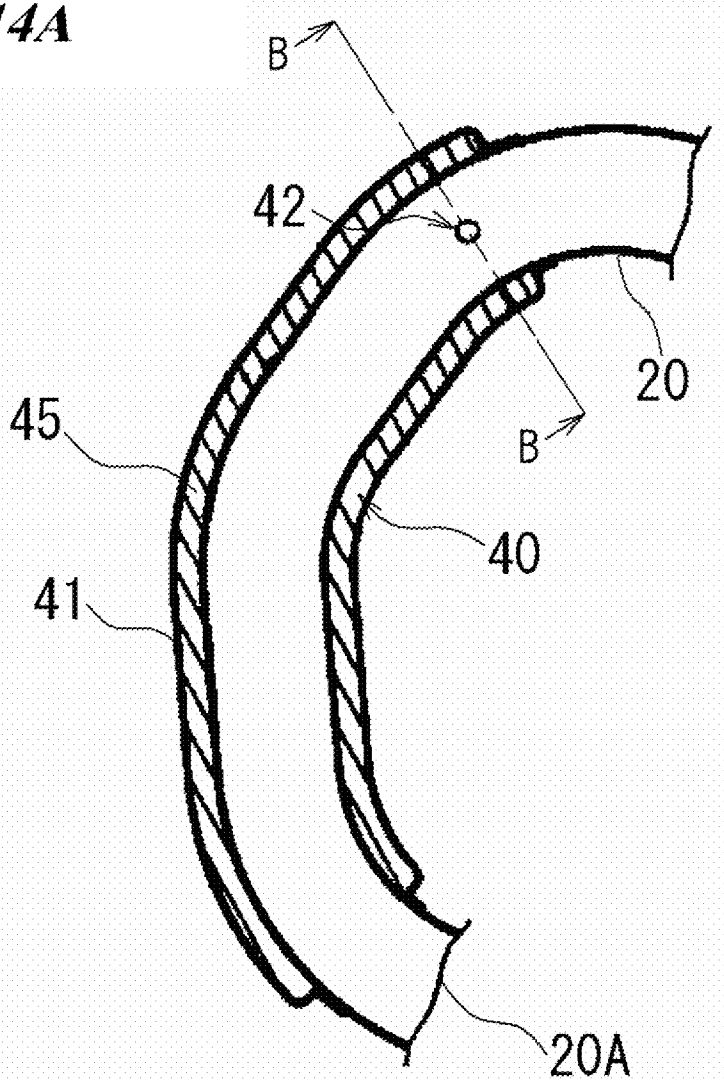
FIG. 14A is a cross sectional view of an exhaust pipe 20 according to embodiment 6 of the present invention.
Figure 14B:
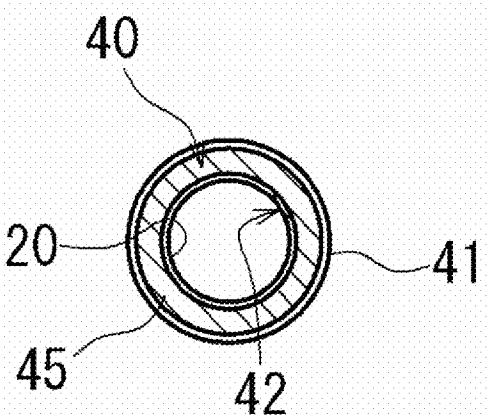
FIG. 14B is a cross sectional view cut along the line B-B in FIG. 14A.

In embodiment 6 illustrated in FIG. 13, the opening (hole) 42, which communicates with the inside of the exhaust pipe 20, is formed in the downstream side in the resonator 40. FIG. 14A is a cross sectional view of the exhaust pipe 20 including the resonator 40 shown in FIG. 13. FIG. 14B is a cross sectional view cut along the line B-B in FIG. 14A.

Figure 15:
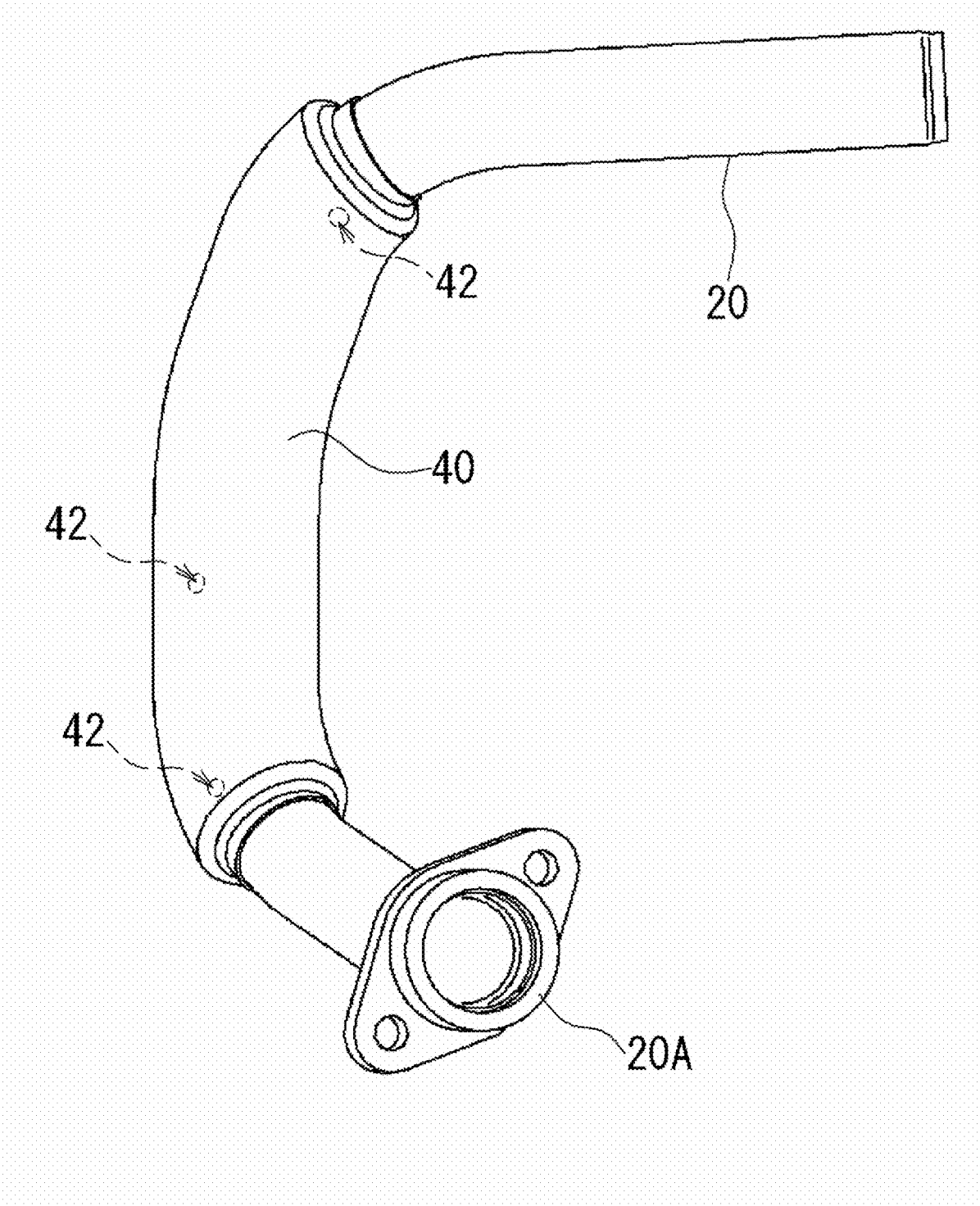
FIG. 15 is a perspective view representing an exhaust pipe 20 according to embodiment 7 of the present invention.
Figure 16A:
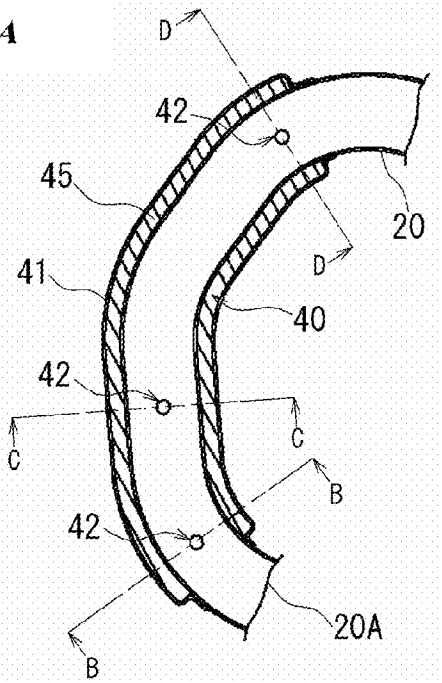
FIG. 16A is a cross sectional view of an exhaust pipe 20 according to embodiment 7 of the present invention.
Figure 16D:
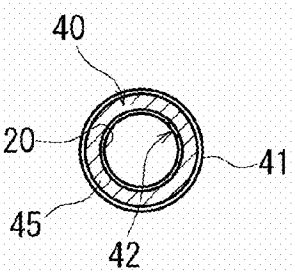
FIG. 16D is a cross sectional view cut along the lines D-D in FIG. 16A.
Figure 16B:
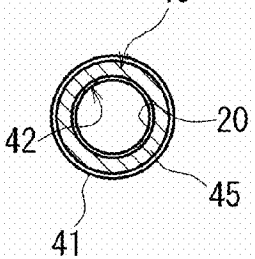
FIG. 16B is a cross sectional view cut along the lines B-B in FIG. 16A.
Figure 16C:
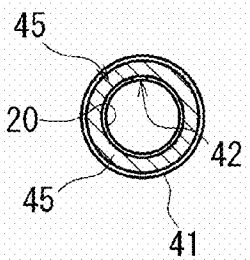
FIG. 16C is a cross sectional view cut along the lines C-C in FIG. 16A.

In embodiment 7 illustrated in FIG. 15, the openings 42 are formed in the upstream side, the downstream side, and midstream there between, in the resonator 40. Three openings 42, which communicate with the exhaust pipe 20, are formed in the resonator 40. FIG. 16A is a cross sectional view of the exhaust pipe 20 including the resonator 40 shown in FIG. 15. FIG. 16B, FIG. 16C, and FIG. 16D are cross sectional views cut along the respective lines B-B, C-C, and D-D in FIG. 16A, respectively.

Figure 17:
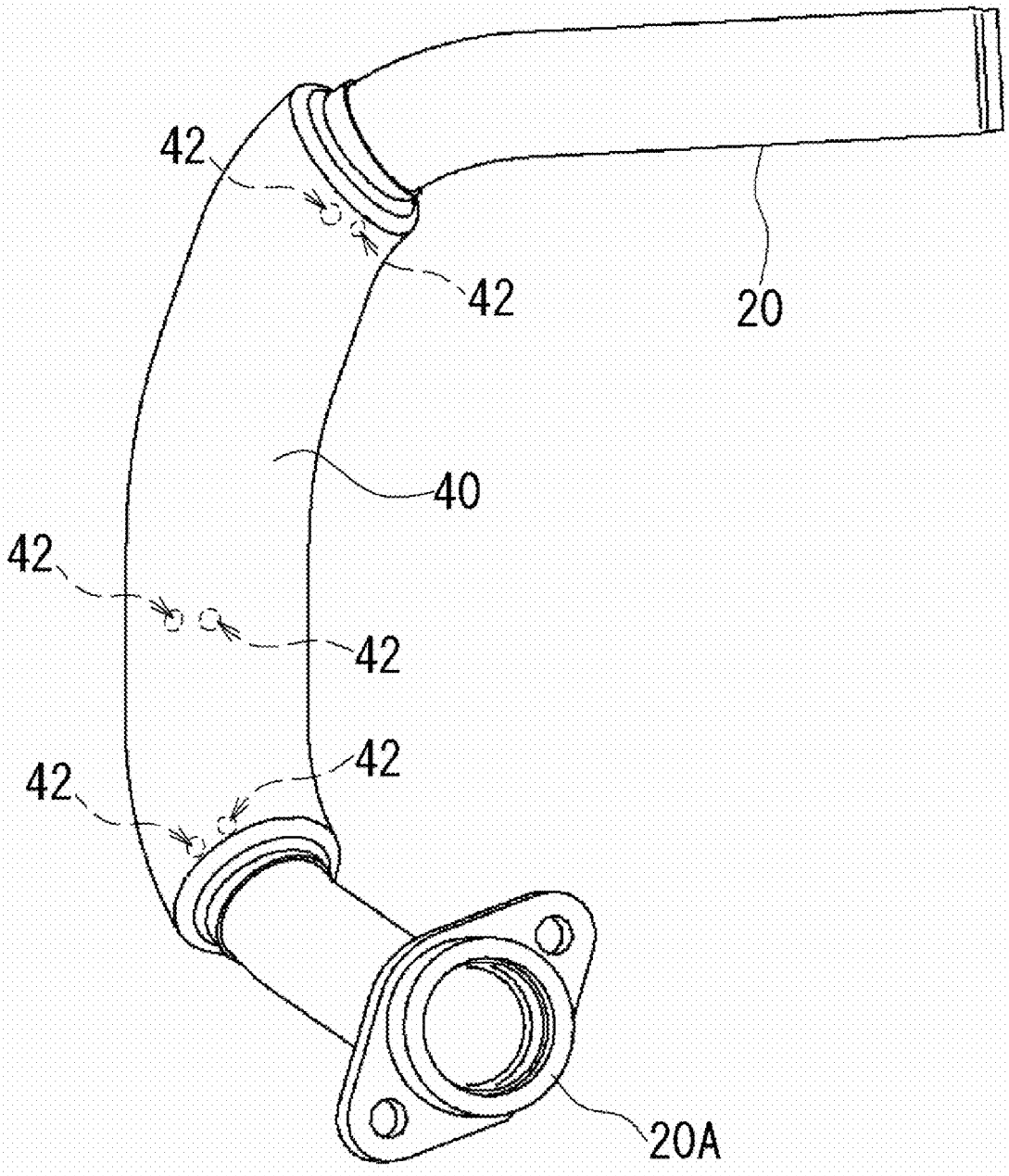
FIG. 17 is a perspective view representing an exhaust pipe 20 according to embodiment 8 of the present invention.
Figure 18A:
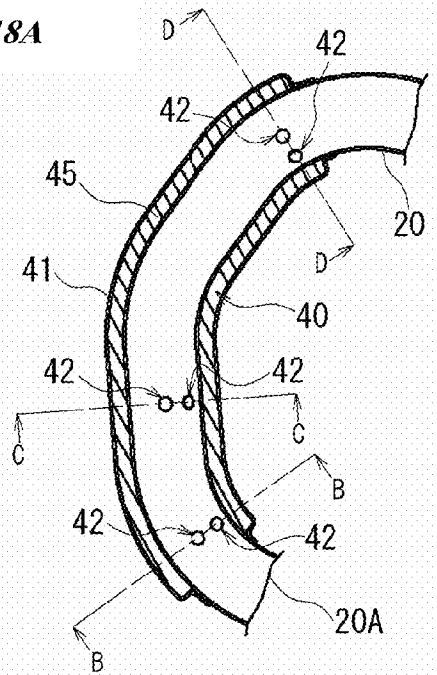
FIG. 18A is a cross sectional view of an exhaust pipe 20 according to embodiment 8 of the present invention.
Figure 18D:
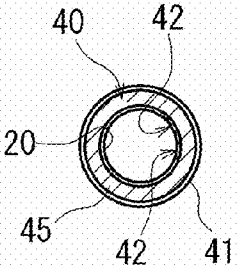
FIG. 18D is a cross sectional view cut along the lines D-D in FIG. 18A.
Figure 18B:
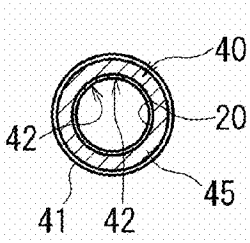
FIG. 18B is a cross sectional view cut along the lines B-B in FIG. 18A.
Figure 18C:
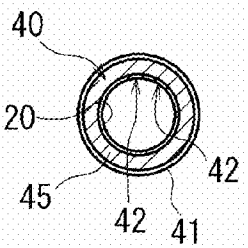
FIG. 18C is a cross sectional view cut along the lines C-C in FIG. 18A.

Furthermore, in embodiment 8 shown in FIG. 17, a pair of openings 42 are formed in each of the upstream side, the downstream side, and midstream there between, in the resonator 40. That is, six openings 42, which communicate with the exhaust pipe 20, are formed in the resonator 40. FIG. 18A is a cross sectional view of the exhaust pipe 20 including the resonator 40 shown in FIG. 17. FIG. 18B, FIG. 18C, and FIG. 18D are cross sectional views cut along the respective lines B-B, C-C, and D-D in FIG. 18A, respectively.

Figure 19:
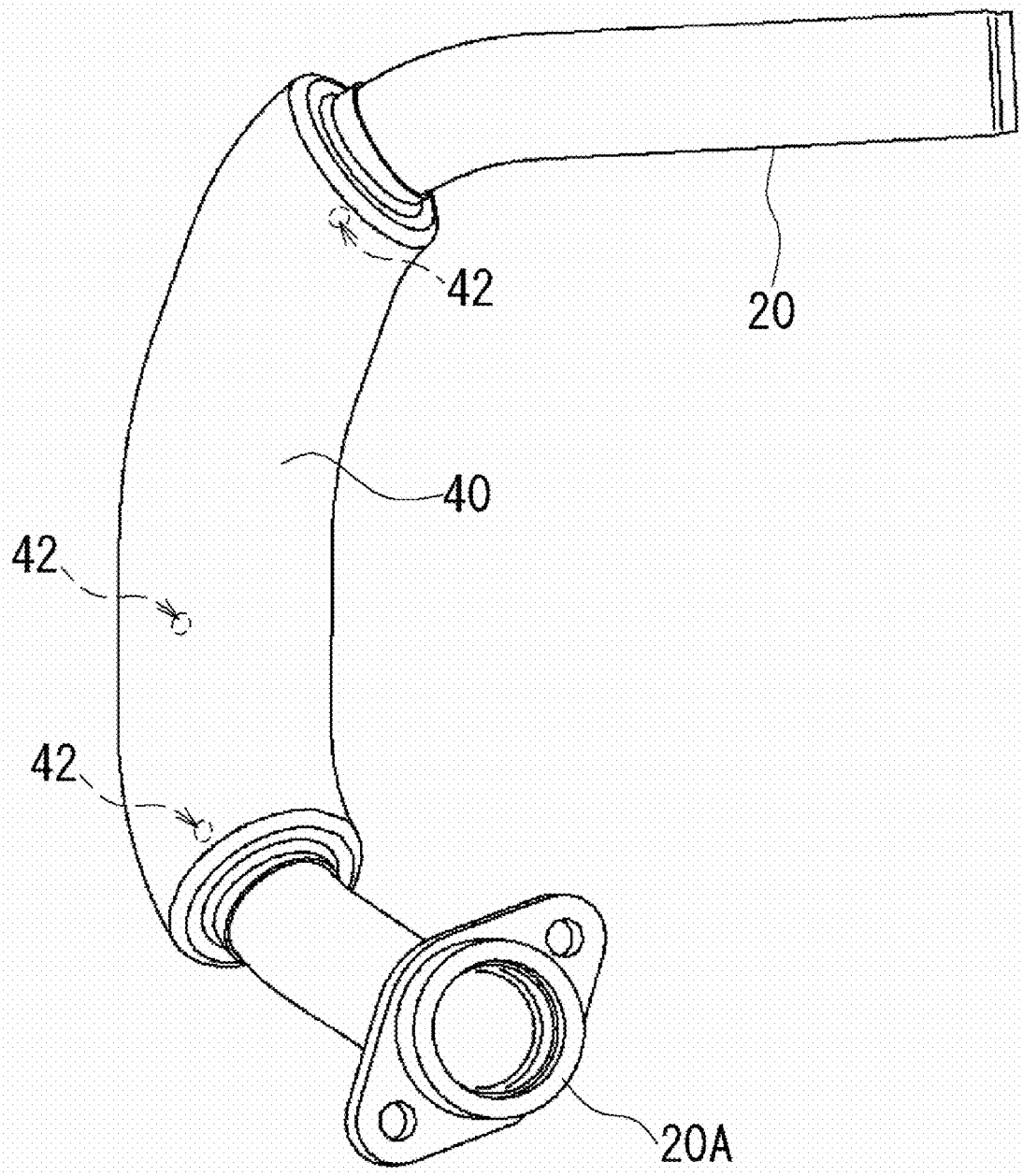
FIG. 19 is a perspective view representing an exhaust pipe 20 according to embodiment 9 of the present invention.
Figure 20A:
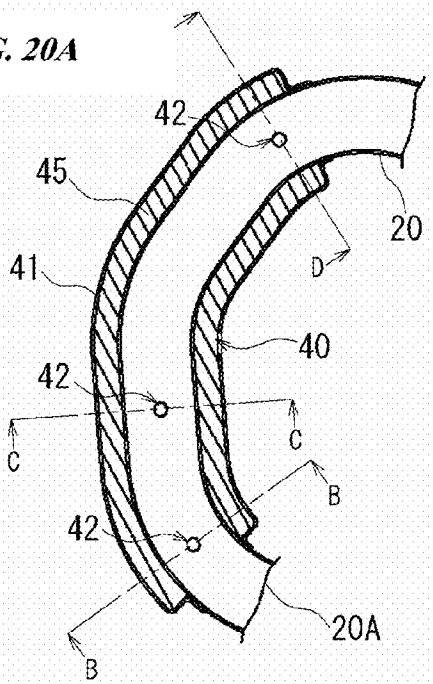
FIG. 20A is a cross sectional view of an exhaust pipe 20 according to embodiment 9 of the present invention.
Figure 20B:
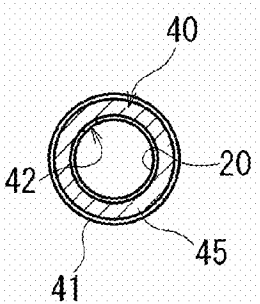
FIG. 20B is a cross sectional view cut along the lines B-B in FIG. 20A.
Figure 20C:
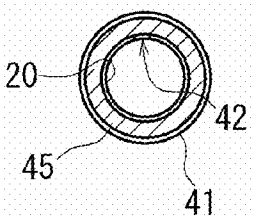
FIG. 20C is a cross sectional view cut along the lines C-C in FIG. 20A.
Figure 20D:
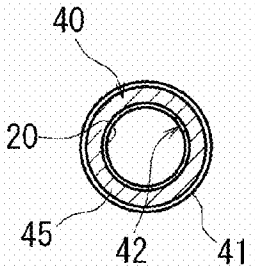
FIG. 20D is a cross sectional view cut along the lines D-D in FIG. 20A.

In embodiment 9, shown in FIG. 19, the capacity V of the resonator 40 of embodiment 7 illustrated in FIG. 15 is nearly doubled. FIG. 20A is a cross sectional view of the exhaust pipe 20 including the resonator 40 shown in FIG. 19. FIG. 20B, FIG. 20C, and FIG. 20D are cross sectional views cut along the respective lines B-B, C-C, and D-D in FIG. 20A, respectively.

Figure 21:
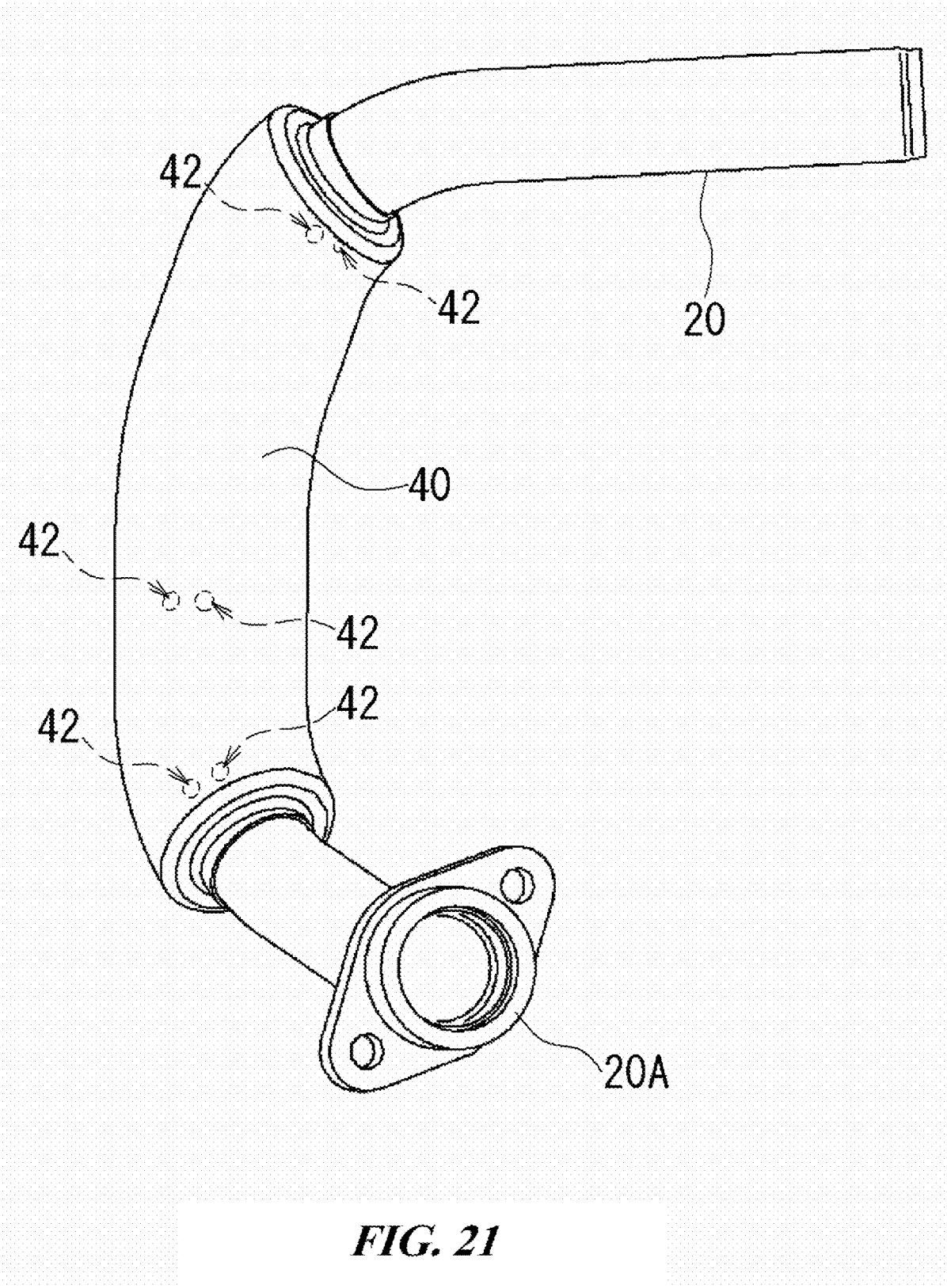
FIG. 21 is a perspective view representing an exhaust pipe 20 according to embodiment 10 of the present invention.
Figure 22A:
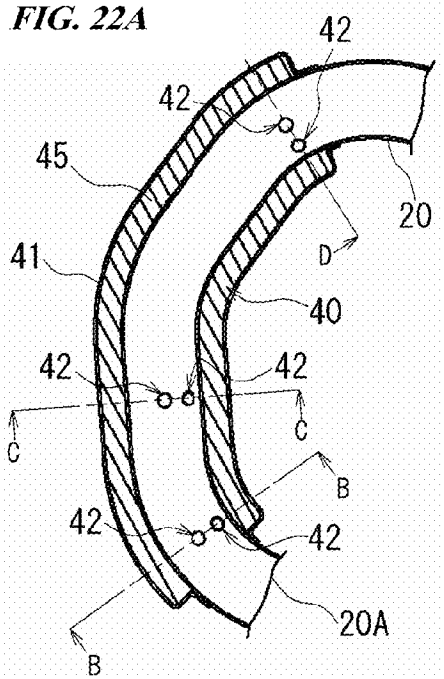
FIG. 22A is a cross sectional view of an exhaust pipe 20 according to embodiment 10 of the present invention.
Figure 22D:
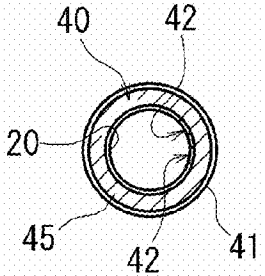
FIG. 22D is a cross sectional view cut along the lines D-D in FIG. 22A.
Figure 22B:
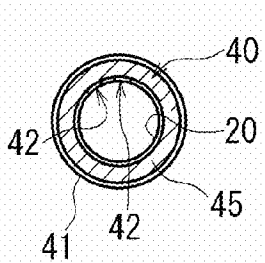
FIG. 22B is a cross sectional view cut along the lines B-B in FIG. 22A.
Figure 22C:
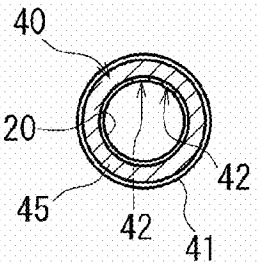
FIG. 22C is a cross sectional view cut along the lines C-C in FIG. 22A.

In embodiment 10 illustrated in FIG. 21, the capacity V of the resonator 40 of embodiment 8 illustrated in FIG. 17 is nearly doubled. FIG. 22A is a cross sectional view of the exhaust pipe 20 including the resonator 40 shown in FIG. 21. FIG. 22B, FIG. 22C, and FIG. 22D are cross sectional views cut along the respective lines B-B, C-C, and D-D in FIG. 22A.

Figure 23:
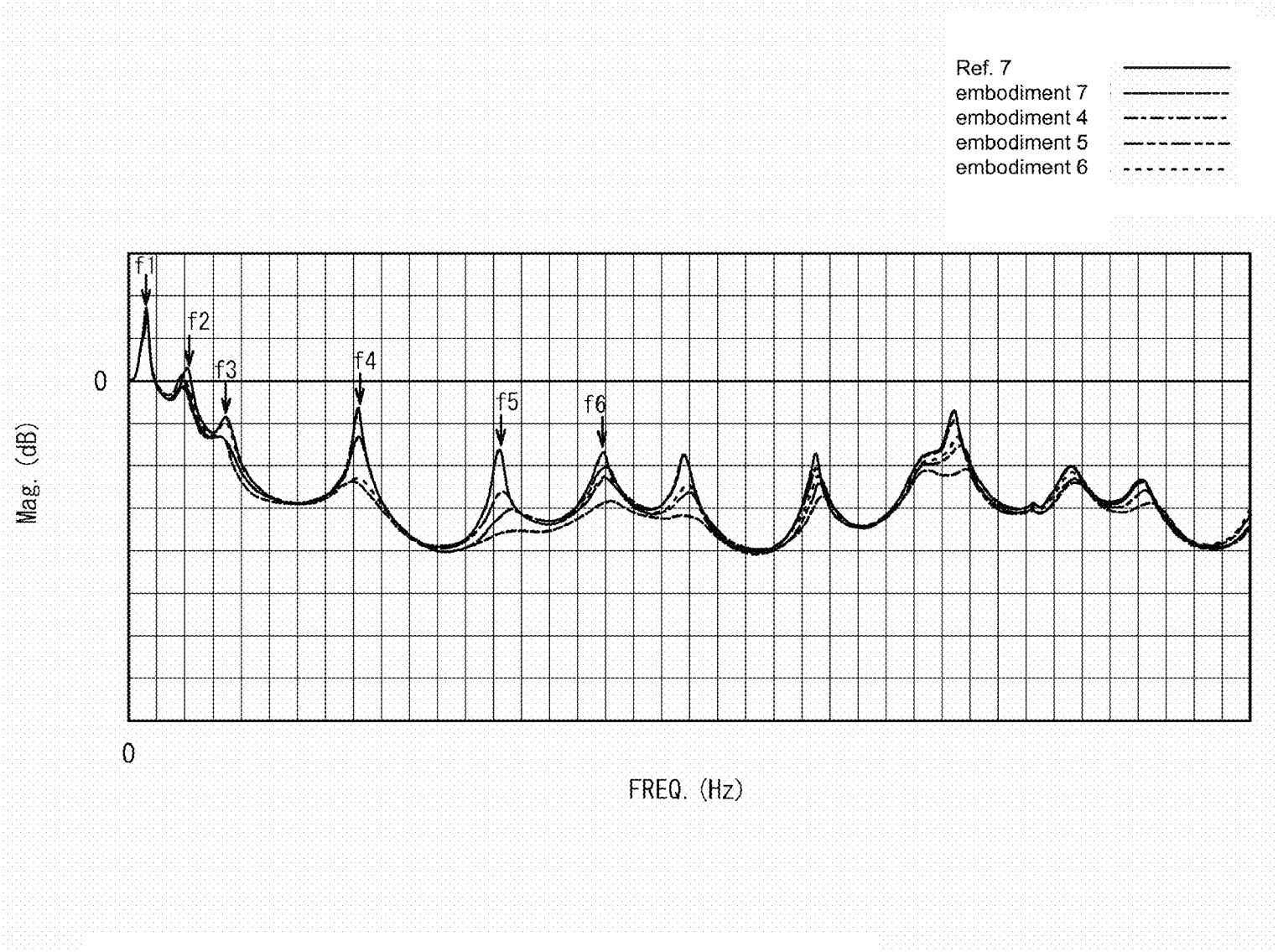
FIG. 23 is a graph for describing a damping characteristic of a construction according to embodiments 4, 5, 6, and 7 of the present invention.

Now, the effects of the exhaust device 100 of embodiments 4-7 are described with reference to FIG. 23. FIG. 23 shows the results of a simulation study done by the inventor of the exhaust device 100. FIG. 23 is a graph showing damping characteristics. The vertical axis represents damping levels (dB), and the horizontal axis represents frequency (Hz). For comparison, the comparative example shown in FIG. 7 (Ref. 7) will be plotted along with, embodiment 4 shown in FIG. 9, embodiment 5 shown in FIG. 11, embodiment 6 shown in FIG. 13, and embodiment 7 shown in FIG. 15. The density (loading weight) of the SUS wool 45 filled in the Helmholtz resonator 40 of each example is the same. Here, the density (loading weight) of the sound absorbing material (SUS wool) 45 is represented by mass (kg) of the sound absorbing material 45 that fills the capacity ($m^3$) of the resonator 40.

Here, the opening 42 on the upstream side of the resonator 40 is formed in the exhaust pipe 20 so as to be located in a place (antinode) where the sound pressure corresponding to the peaks of frequencies f3 and f6 in the drawing are high. The opening 42 on the downstream side of the resonator 40 is formed in the exhaust pipe 20 in a place (antinode) where the sound pressure corresponding to the peak of frequency f4 in the drawing is high. The opening 42, located at the midstream, is formed in the exhaust pipe 20 so as to be located in a place (antinode) where the sound pressure corresponding to the peak of frequency f5 in the drawing is high. The place (antinode) where the sound pressure is high is based on the place in the exhaust pipe 20 where the sound pressure is high before the opening 42 is formed.

As can be understood from FIG. 23, damping levels (dB) of desired frequency peaks can be reduced by forming the openings 42 in certain places. It can be understood that embodiment 7, shown in FIG. 15, illustrates favorable damping characteristics compared to the comparative example (Ref. 7).

Figure 24:
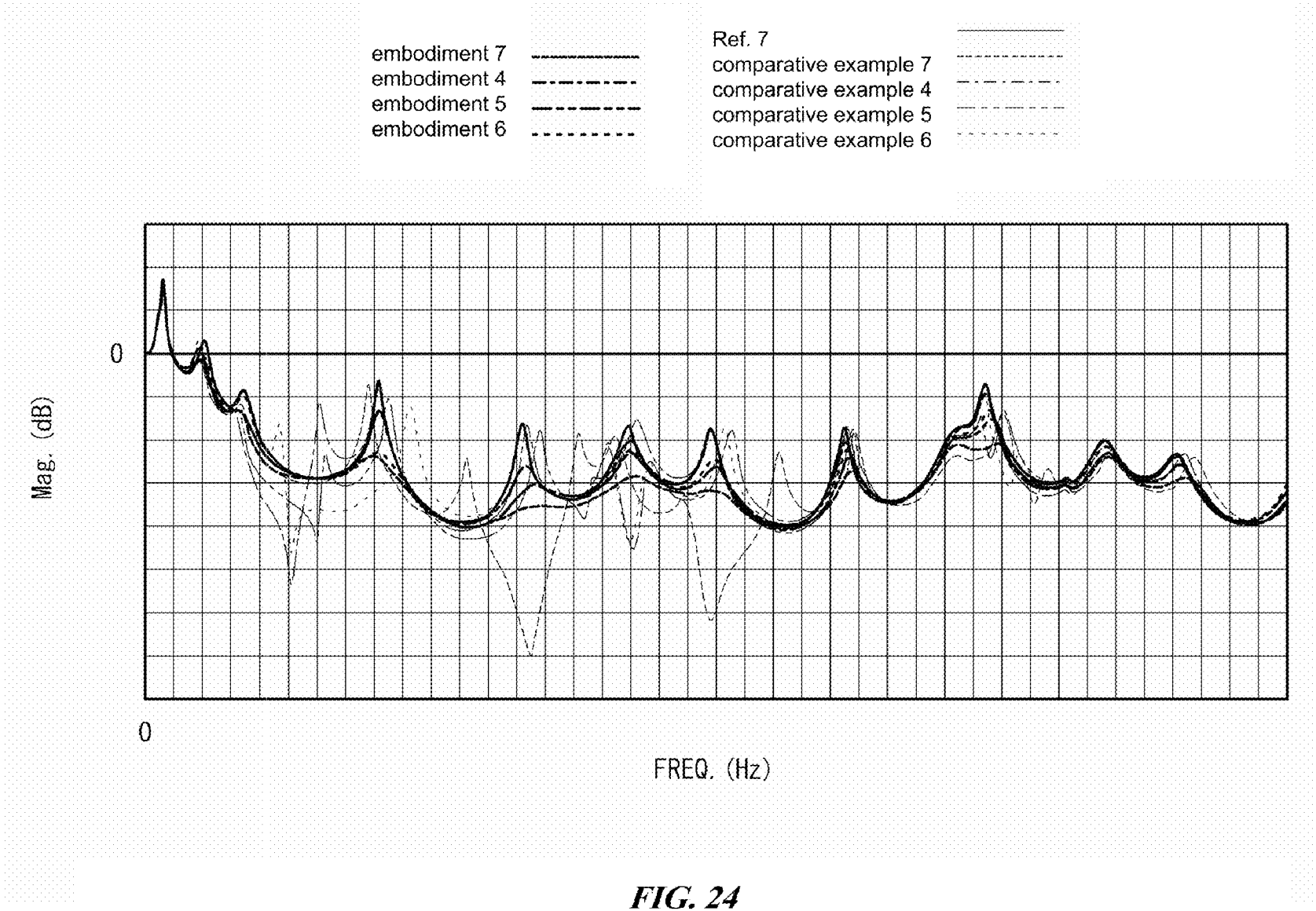
FIG. 24 is a graph for describing a damping characteristic of a construction according to embodiments 4, 5, 6, and 7 of the present invention.

In addition to the result shown in FIG. 23, FIG. 24 also shows comparative examples 4-7 which are identical to embodiments 4-7 except the sound absorbing material 45 is not filled in the resonator 40. Specifically, FIG. 24 also collectively shows the results of: a comparative example 4 similar to embodiment 4 shown in FIG. 9, except without the sound absorbing material 45; a comparative example 5 similar to embodiment 5 shown in FIG. 11, except without the sound absorbing material 45; a comparative example 6 similar to embodiment 6 shown in FIG. 13, except without the sound absorbing material 45; and a comparative example 7 similar to embodiment 7 shown in FIG. 15, except without the sound absorbing material 45. Numerals of comparative examples without the sound absorbing material 45 (for example, comparative example 5) are indicated by the same numerals as the embodiment with the sound absorbing material 45 (for example, embodiment 5).

As can be understood from FIG. 24, in the case of comparative examples 4-7 in which the sound absorbing material 45 is not filled in the resonator 40, a damping level of specific frequency f can be largely reduced. However, new peaks are generated on both sides thereof, which worsens the overall damping characteristics.

Figure 25:
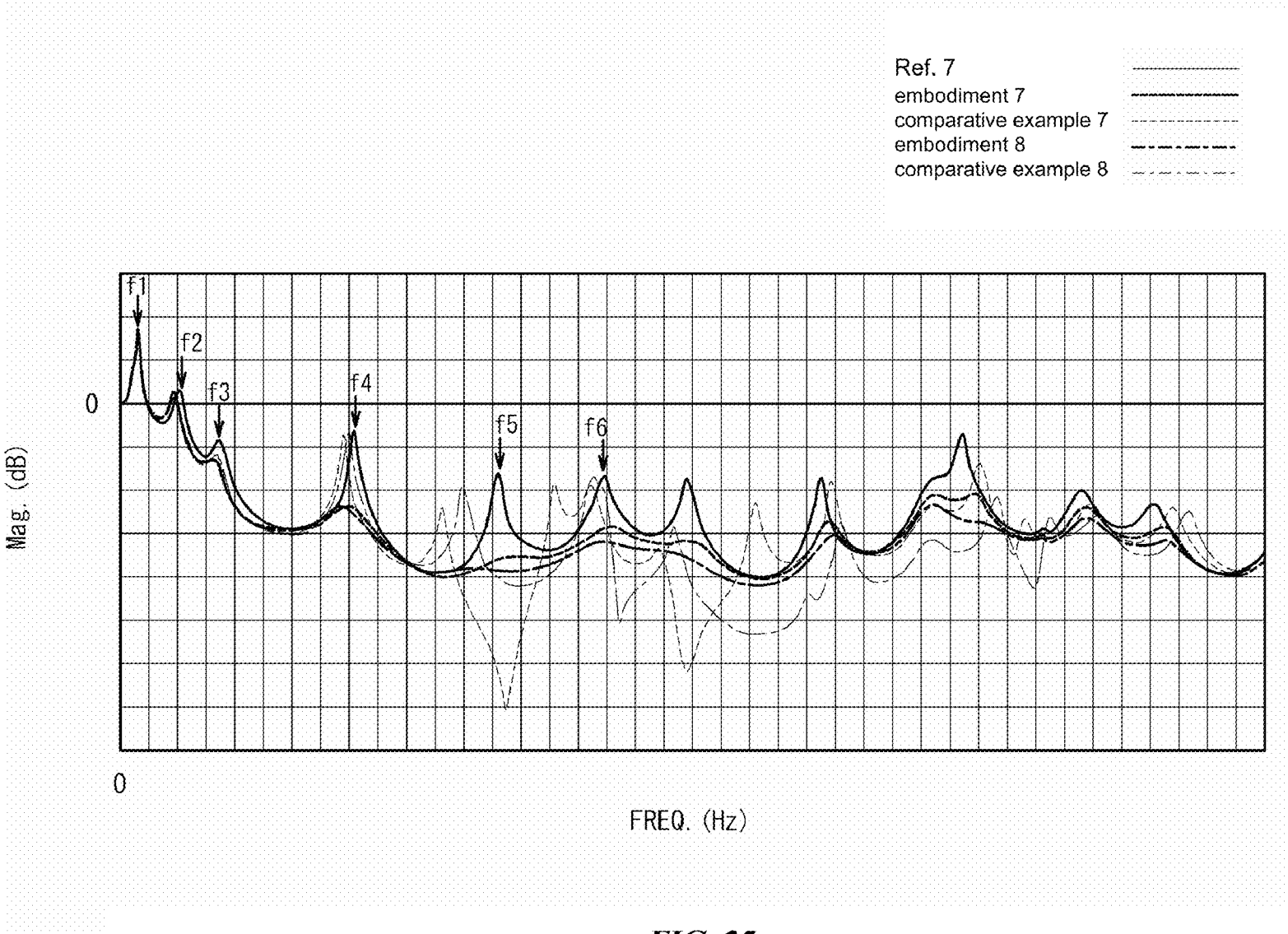
FIG. 25 is a graph for describing a damping characteristic of a construction according to embodiments 7 and 8 of the present invention.

FIG. 25 shows the damping characteristics of embodiment 8 shown in FIG. 17. In addition, FIG. 25 shows a comparative example 8, similar to embodiment 8, except without the sound absorbing material 45. In addition, FIG. 25 illustrates the comparative example (Ref. 7), and embodiment 7 and comparative example 7.

As can be understood from FIG. 25, an embodiment having six openings 42, similar to embodiment 8, is at least equivalent to or superior in damping characteristics than an embodiment having three openings 42 similar to embodiment 7.

Figure 26:
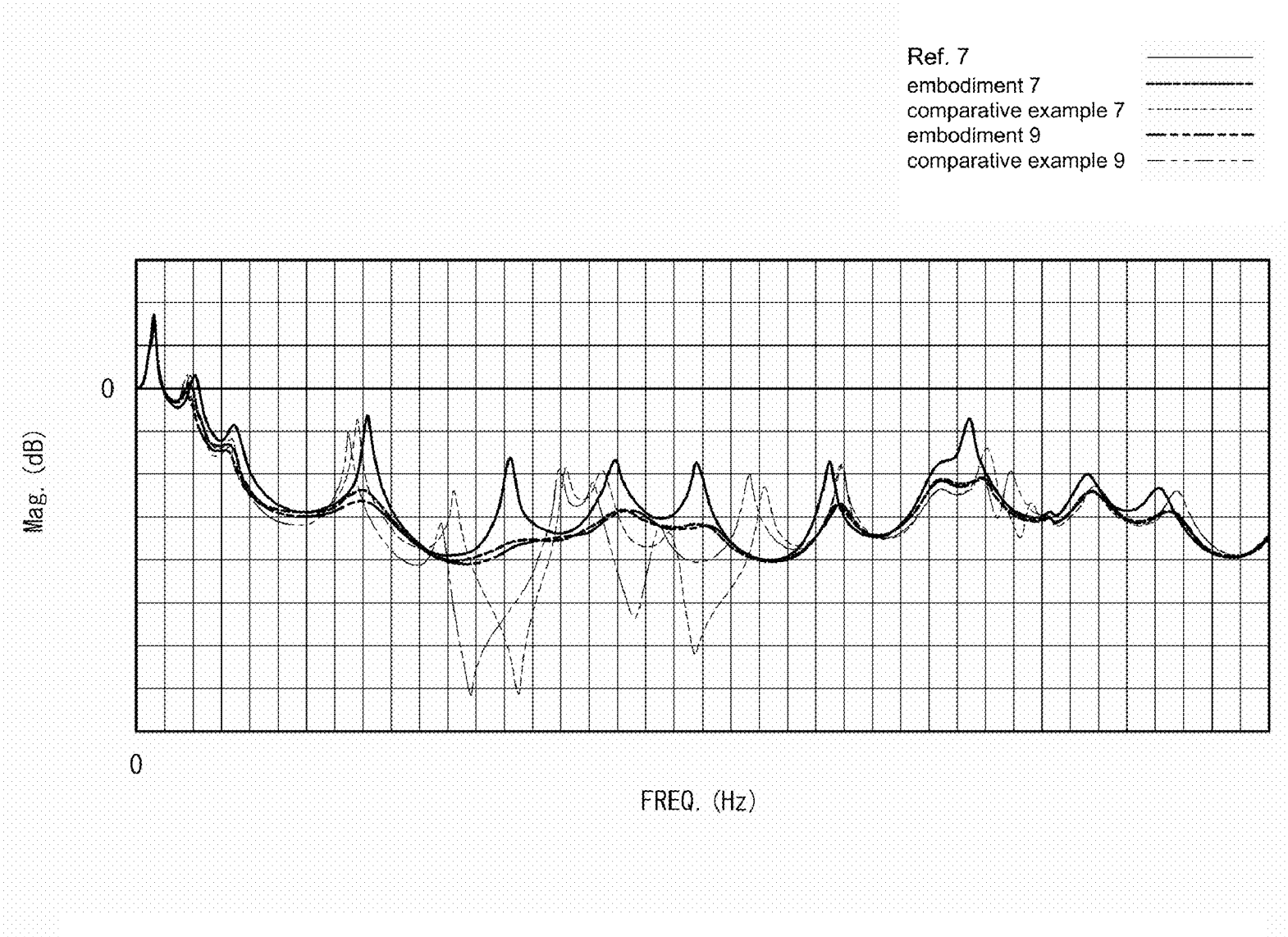
FIG. 26 is a graph for describing a damping characteristic of a construction according to embodiments 7 and 9 of the present invention.

FIG. 26 shows the damping characteristics of embodiment 9 shown in FIG. 19. FIG. 26 also shows a comparative example 9 which is similar to embodiment 9 except without the sound absorbing material 45. In addition, FIG. 26 illustrates the comparative example (Ref. 7), and embodiment 7 and comparative example 7.

Figure 27:
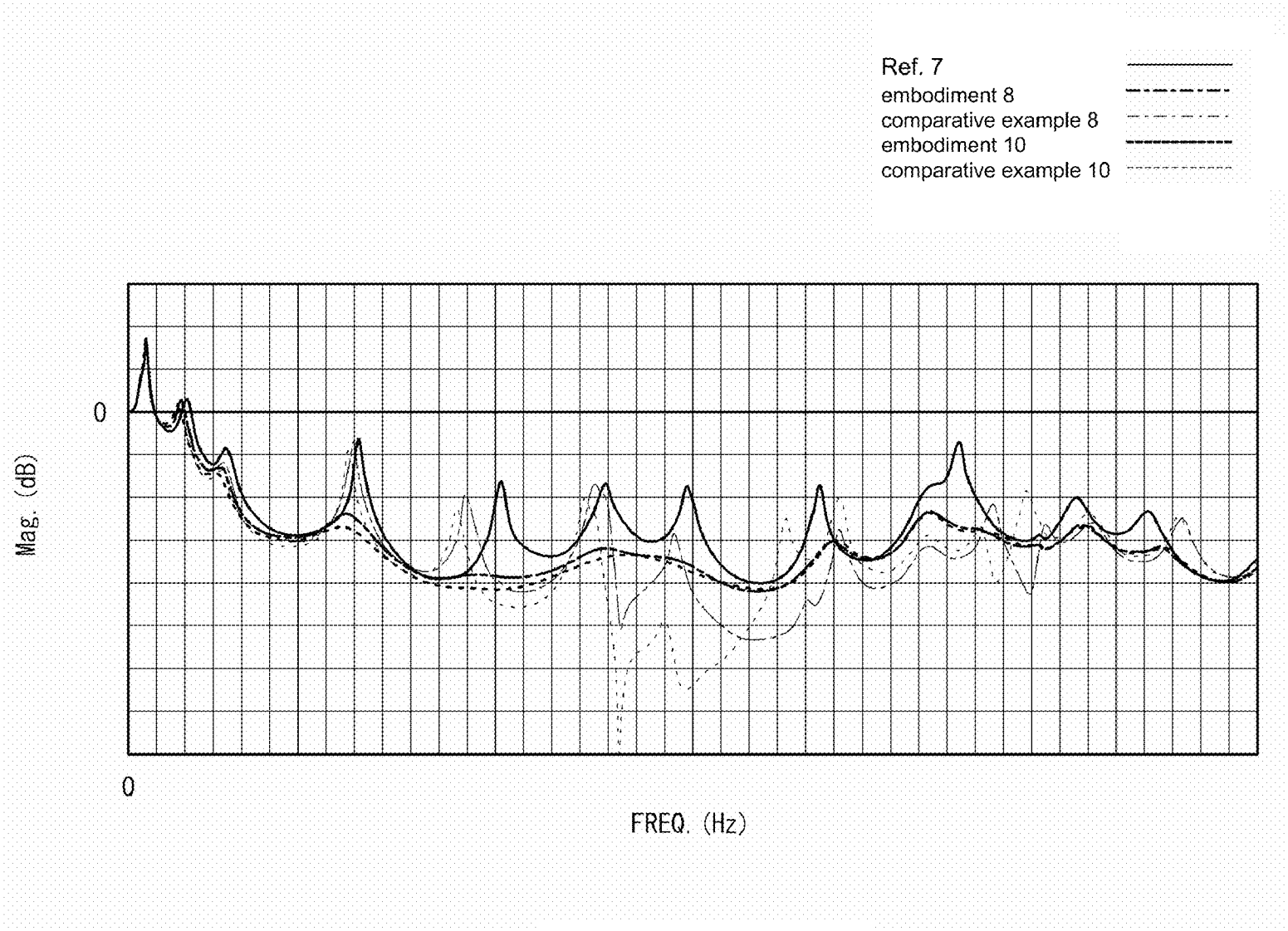
FIG. 27 is a graph for describing a damping characteristic of a construction according to embodiments 8 and 10 of the present invention.

As can be understood from FIG. 26, an embodiment in which the capacity of the resonator 40 is enlarged similar to embodiment 9, has equivalent or superior damping characteristics to similar embodiments with smaller capacities like embodiment 7. In addition, as shown in FIG. 27, an embodiment 10 shown in FIG. 21, in which the capacity of the resonator 40 is enlarged, has equivalent or superior damping characteristics to similar embodiments with smaller capacities such as embodiment 8. In FIG. 27, a comparative example 10, similar to embodiment 10 except without the sound absorbing material 45, is also shown.

According to the embodiments of the present invention, the Helmholtz resonator 40 is disposed on the exhaust pipe 20, and a sound absorbing material 45 fills the Helmholtz resonator 40. Damping characteristics are improved by the Helmholtz resonator 40. At the same time, by filling the Helmholtz resonator 40 with sound absorbing material 45, peak levels of the resonance frequencies newly caused by the Helmholtz resonator 40 can be suppressed. As a result, the sound deadening effect can be enhanced even in situations where the silencer capacity cannot be enlarged because of weight considerations.

In the foregoing, the present invention is described with a preferable embodiment. However, the descriptions are not limitations, and various modifications are of course possible.

What is claimed is:

1. An exhaust device for a straddle type vehicle with an internal combustion engine, the exhaust device comprising:

an exhaust pipe having an engine attachment means at one end, wherein the exhaust pipe comprises a Helmholtz resonator, the Helmholtz resonator is filled with a sound absorbing material, and the Helmholtz resonator is formed with an opening in communication with an inside of the exhaust pipe, and wherein the opening is formed in a place where sound pressure in the exhaust pipe is high when the exhaust pipe is connected to the engine and the engine is operating; and a silencer connected to the exhaust pipe; and wherein:

the Helmholtz resonator is filled with sufficient sound absorbing material to substantially eliminate a peak level of a resonance frequency that would be generated in the exhaust pipe by the Helmholtz resonator in the absence of the sound absorbing material.

2. The exhaust device according to claim 1, wherein the place where sound pressure is high is a place corresponding to an antinode based on a standing wave from a third peak to a sixth peak in the exhaust pipe.

3. The exhaust device according to claim 1, wherein the sound absorbing material comprises SUS wool.

4. The exhaust device according to claim 1, wherein the sound absorbing material comprises glass wool.

5. The exhaust device according to claim 1, wherein the sound absorbing material has a sufficient bulk density to substantially suppress a sound absorbing effect of the Helmholtz resonator at the resonant frequency of the Helmholtz resonator.

6. A straddle-type vehicle comprising:

an exhaust pipe connected at one end to an engine of the straddle-type vehicle, wherein the exhaust pipe comprises a Helmholtz resonator, the Helmholtz resonator is filled with a sound absorbing material, and the Helmholtz resonator is formed with an opening in communication with an inside of the exhaust pipe, and wherein the opening is formed in a place where sound pressure in the exhaust pipe is high when the exhaust pipe is connected to the engine and the engine is operating; and a silencer connected to the exhaust pipe; and wherein:

the Helmholtz resonator is filled with sufficient sound absorbing material to substantially eliminate a peak level of a resonance frequency that would be generated in the exhaust pipe by the Helmholtz resonator in the absence of the sound absorbing material.

7. The straddle-type vehicle according to claim 6, wherein the place where sound pressure is high is a place corresponding to an antinode based on a standing wave from a third peak to a sixth peak in the exhaust pipe.

8. The straddle-type vehicle according to claim 6, wherein the sound absorbing material comprises SUS wool.

9. The straddle-type vehicle according to claim 6, wherein the sound absorbing material comprises glass wool.

10. The straddle-type vehicle according to claim 6, wherein the sound absorbing material has a sufficient bulk density to substantially suppress a sound absorbing effect of the Helmholtz resonator at the resonant frequency of the Helmholtz resonator.

11. The straddle-type vehicle according to claim 6, wherein the straddle type vehicle comprises a four-cycle engine.

12. An exhaust device for an internal combustion engine, the exhaust device comprising:

an exhaust pipe having an upstream side and a downstream side;

a silencer connected to the exhaust pipe;

a hollow body disposed around the exhaust pipe upstream of the silencer;

a resonator space formed between the exhaust pipe and the hollow body, the resonator space being filled with sufficient sound absorbing material to substantially eliminate a peak level of a resonance frequency that would be generated in the exhaust pipe by the Helmholtz resonator in the absence of the sound absorbing material;

a first closure connecting an upstream side of the exhaust pipe to an upstream end of the hollow body and enclosing an upstream end of the resonator space;

a second closure connecting a downstream side of the exhaust pipe to a downstream end of the hollow body and enclosing a downstream end of the resonator space; and at least one opening providing gas communication between the exhaust pipe and the resonator space, wherein the at least one opening is formed in at least one place where sound pressure in the exhaust pipe is high when the upstream side of the exhaust pipe is connected to the internal combustion engine and the engine is running.

13. The exhaust device according to claim 12, wherein the at least one place where sound pressure in the exhaust pipe is high is a place corresponding to an antinode based on a standing wave from a third peak to a sixth peak in the exhaust pipe.

14. The exhaust device according to claim 12, wherein the sound absorbing material comprises SUS wool.

15. The exhaust device according to claim 12, wherein the sound absorbing material comprises glass wool.

16. An exhaust device for an internal combustion engine, the exhaust device comprising:

an exhaust pipe configured at one end to be connected to the internal combustion engine;

a Helmholtz resonator formed about the exhaust pipe, the Helmholtz resonator filled with a sound absorbing material, the density of the sound absorbing material within the resonator being sufficient to substantially reduce a sound absorbing effect of the Helmholtz resonator at the resonant frequency of the Helmholtz resonator and reduce a peak level of generated resonance frequency caused by the Helmholtz resonator; and at least one opening providing gas communication between the exhaust pipe and the Helmholtz resonator, wherein the at least one opening is formed in at least one place where sound pressure in the exhaust pipe is high when the exhaust pipe is connected to the internal combustion engine and the engine is running.

* * * * *